US008543019B2

(12) United States Patent
Takemura

(10) Patent No.: US 8,543,019 B2
(45) Date of Patent: Sep. 24, 2013

(54) IMAGE FORMING APPARATUS

(75) Inventor: Taichi Takemura, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 48 days.

(21) Appl. No.: 13/355,799

(22) Filed: Jan. 23, 2012

(65) Prior Publication Data

US 2012/0189337 A1 Jul. 26, 2012

(30) Foreign Application Priority Data

Jan. 24, 2011 (JP) ..... 2011-012319

(51) Int. Cl.
*G03G 15/00* (2006.01)

(52) U.S. Cl.
USPC ..... 399/45; 399/341; 399/342

(58) Field of Classification Search
USPC ..... 399/45, 46, 68, 341, 342
See application file for complete search history.

(56) References Cited

U.S. PATENT DOCUMENTS 8,150,280 B2 * 4/2012 Omata ..... 399/45
2011/0182607 A1 7/2011 Takemura
2012/0014702 A1 1/2012 Takemura

FOREIGN PATENT DOCUMENTS

JP 4-338984 A 11/1992
JP 2008-139589 A 6/2008

* cited by examiner

*Primary Examiner* — Hoang Ngo
(74) *Attorney, Agent, or Firm* — Fitzpatrick, Cella, Harper & Scinto

(57) ABSTRACT

An image forming apparatus includes control device for selectively executing a first mode in which the non-transparent toner image is formed, then the transparent toner image is formed on the sheet not yet heated, then the sheet is subjected to the heating or a second mode in which the non-transparent toner image is formed, then the transparent toner image is formed on the sheet subjected to the heating, then the sheet is subjected to the heating; and storing device for storing selection information compared with information of amount of the non-transparent toner image, wherein the selection information indicates which mode provides larger difference in glossiness of the image fixed by the fixing device between when the transparent toner image of a predetermined amount is overlaid on the non-transparent toner image of a amount to be formed on the sheet and when the transparent toner image is not overlaid.

4 Claims, 15 Drawing Sheets

IMAGE FORMING APPARATUS

FIELD OF THE INVENTION AND RELATED ART

The present invention relates to an electrophotographic image forming apparatus which forms an image on recording medium with the use of a combination of color (non-transparent) toner and transparent (clear) toner. More specifically, it relates to an electrophotographic image forming apparatus capable of outputting a print, the selected area or areas of a sheet of recording medium of which are different in gloss level from the rest, with the use of transparent toner.

There has been desired in the print market to produce a print, the value of which is significantly higher than its basic value. One of the examples of such a print is a print, the selected area or areas of the image formation area of the sheet of recording medium of which are different in gloss level from the rest.

Thus, there have been proposed various methods to be used by an electrophotographic image forming apparatus to output such a print as the one described above, that is, a print, the selected area or areas of the image formation areas of the sheet of recording medium of which are different in gloss level from the rest. One of such methods is to use transparent toner (Japanese Laid-open Patent Application H04-338984 and Japanese Laid-open Patent Application 2008-139589).

The method disclosed in Japanese Laid-open Patent Application H04-338984 to adjust in gloss a selected area or selected areas of recording medium with the use of transparent toner is as follows: First, a toner image is to be formed with the use of a color toner or color toners. Then, a transparent toner image is formed on the color toner image so that the transparent toner image covers the selected area or areas of the color toner image. Then, the color toner image and transparent toner image are to be transferred together onto recording medium, and are to be fixed to the recording medium. This method makes it possible for an electrophotographic image forming apparatus to output a print, the selected area or selected areas of which are different in gloss level from the rest.

The method disclosed in Japanese Laid-open Patent Application 2008-139589 to adjust in gloss a selected area or selected areas of recording medium with the use of transparent toner is as follows: First, a color toner image is formed and transferred onto recording medium, and is fixed (first fixation). Then, after the print is moved out of the fixing means, a transparent toner image is transferred onto the print, and is fixed (second fixation). This method also makes it possible for an electrophotographic image forming apparatus to output a print, a selected or selected areas of the image formation area of the recording medium of which are different in gloss level from the rest.

Roughly speaking, there are two groups of methods for adjusting in gloss a selected area or selected areas of a sheet of recording medium with the use of transparent toner. The two groups are different in the number of times a sheet of recording medium is put through the fixation process. More specifically, one group puts a sheet of recording medium only once through a fixing means to fix both the color toner image and transparent image to the sheet of recording medium (this method hereafter is referred to as "single-pass image formation method"). The other group puts a sheet of recording medium through a fixing means twice. That is, it puts a sheet of recording medium through a fixing means (first fixation) immediately after the formation of a color toner image on the sheet. Then, it forms a transparent image over the fixed color toner image on the sheet of recording medium, and then, puts the sheet of recording medium through the fixing means for the second time (second fixation) (this method hereafter is referred to as "double-pass image formation method").

SUMMARY OF THE INVENTION

However, the above-mentioned singe-pass method or double-pass method sometimes turned out not to be as effective as expected. That is, either method is affected in effectiveness by the density of a color image. In other words, unless a color image is just right in density, a selected or selected areas of a sheet of recording medium are not going to be distinct in glossiness from the rest.

That is, it became evident that there is a color image density range in which it is difficult to make a given area or areas of the color image on a sheet of recording medium different in gloss level from the rest with the use of the combination of transparent toner and single-pass method, or the combination of transparent toner and double-pass method.

It became also evident that in terms of which of the singe-pass method and double-pass method is better to make an electrophotographic image forming apparatus to output a print, the area or areas of which are distinct in glossiness from the rest, the relationship between the color image density and the two methods is affected by the type of recording medium used for image formation.

Thus, the primary object of the present invention is to provide an image forming apparatus which is simple in structure and yet is capable of making a selected or selected areas of the image formation area of a sheet of recording medium distinct in gloss from the rest after the formation of a color toner image on the sheet S, regardless of the density of an image formed of color toner or toners.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENTS

Hereinafter, the image forming apparatuses in the preferred embodiments of the present invention are described in more detail with reference to the appended drawings.

[Embodiment 1]

1. General Structure and Operation of Image Forming Apparatus

Figure 1:
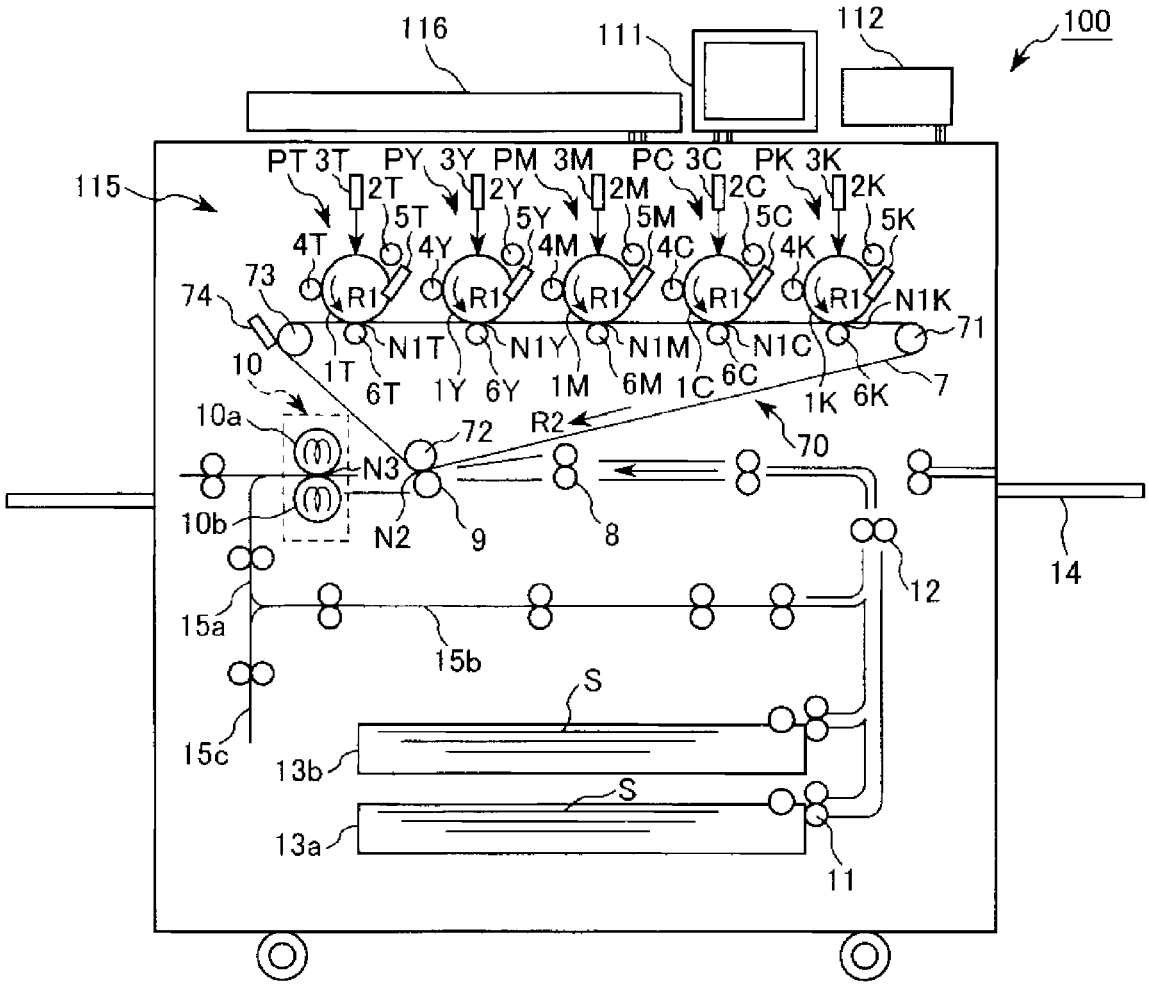
FIG. 1 is a schematic sectional view of the image forming apparatus in the first preferred embodiment of the present invention, and shows the general structure of the apparatus.
Figure 2:
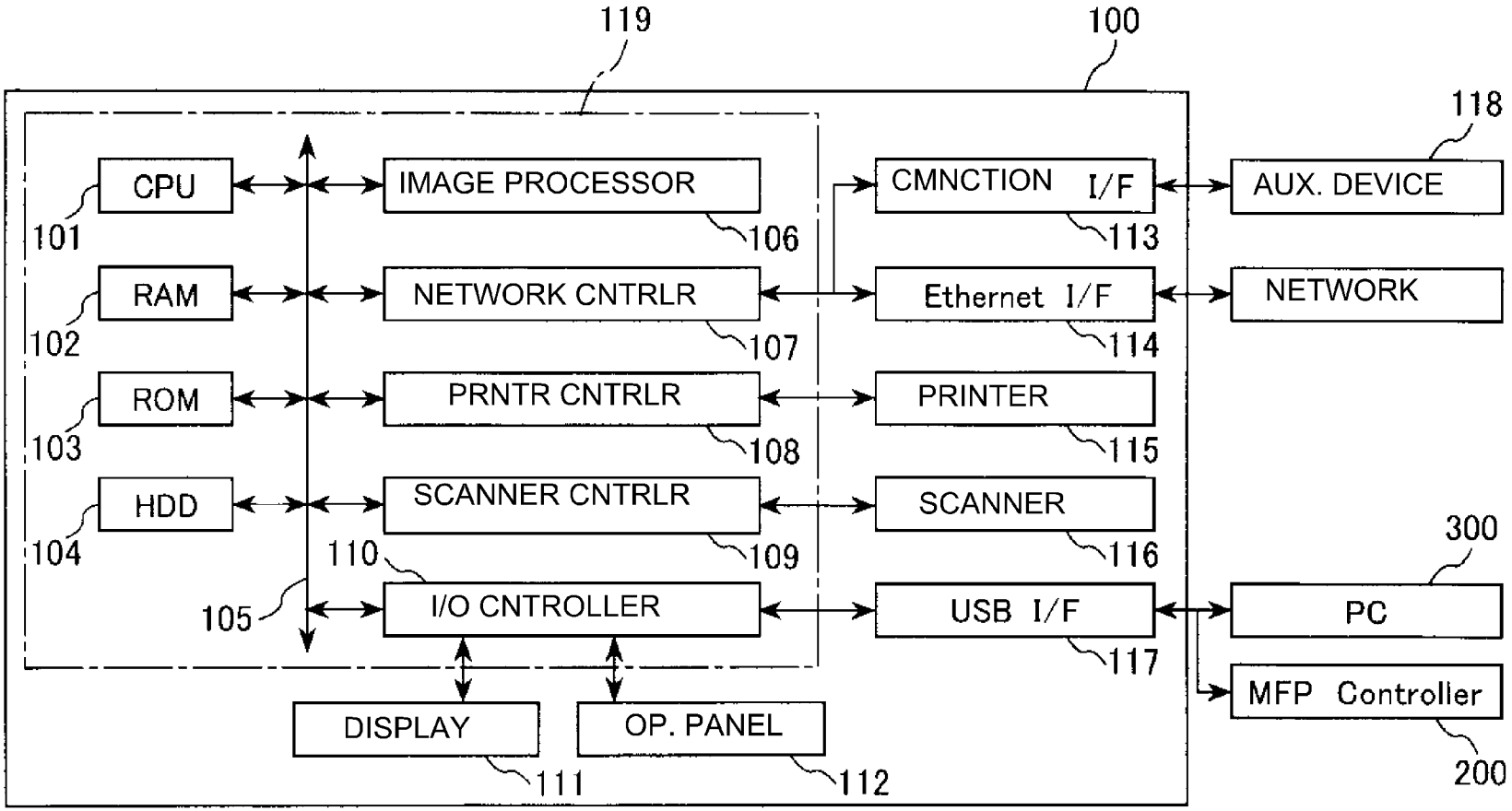
FIG. 2 is a block diagram of the control sequence of the image forming apparatus in the first preferred embodiment.

To begin with, the general structure and operation of the image forming apparatus in the first preferred embodiment of the present invention are described. FIG. 1 is a vertical schematic sectional view of the image forming apparatus in this embodiment. It shows the general structure of the apparatus. FIG. 2 is a block diagram of the hardware structure of the image forming apparatus of the image forming apparatus 100 in this embodiment.

The image forming apparatus 100 in this embodiment is an electrophotographic multifunction peripheral capable of functioning as a copying machine, a printer, etc. Not only can it form a full-color image and a monochromatic image, but also, it can output a print, the selected area or areas of the sheet S of recording medium of which are different in gloss level from the rest, with the use of a combination of color toner and transparent toner.

The image forming apparatus 100 has: a controller section 119 as a controlling means; a scanner section 116 as an image reading means; a printer section 115, a display section 111 as a displaying means; a control panel 112 as an information inputting means; an interface section; etc.

1-1. Controller Section

First, the controller section 119 is described. The CPU 101 (Central Processing Unit), RAM 102 (Random Access Memory), and ROM 103 (Read Only Memory) of the controller section 119 are in connection to a bus 105. Similarly, the HDD 104 (Hard Disk Drive), dedicated image formation circuit 106, network controller 107, printer controller 108, scanner controller 109, and I/O controller 110 also are in connection to the bus 105. Thus, these sections and units which are in connection to the bus 105 can communicate with each other through the bus 105.

Since the image forming apparatus 100 is structured as described above, it is through the bus 105 that the CPU 101 can transmit a control command or the like, to the HDD 104, network controller 107, printer controller 108, scanner controller 109, and I/O controller 110. It is also through the bus 105 that the CPU 101 receives signals which show the state of HDD 104, network controller 107, printer controller 108, scanner controller 109, and I/O controller 110, and such data as the image data. Thus, the CPU 101 can control the various sections and units of which the image forming apparatus 100 is made up. Next, the operation of each unit and that of each section are described.

The CPU 101 and dedicated image processing circuit 106 unfold the programs stored in the ROM 103, for example, in the primary memory (called registry) of the CPU and dedicated image processing circuit 106, and carry out the developed programs. The RAM 102 is shared as the secondary memory which is necessary for the CPU 101 and dedicated image processing circuit 106 to carry out the programs. The HDD 104 which is significantly greater in storage capacity than the ROM 103, is primarily used for storing the image data in the image forming apparatus 100.

The network controller 107 is a circuit used by the image forming apparatus 100 (CPU 101) to communicate with external devices. It modulates the signals transmitted from the CPU 101, so that the signals meet the specifications of the various units and sections of the image forming apparatus 100. For example, in order for the network controller 107 to transmit to the network the signal from the CPU 101 through Ethernet (Registered Trade Mark) I/F 114, it converts the signals into multi-value signals which meet IEEE standard 803.2. Further, as the network controller 107 receives multi-value signals from the network through Ethernet I/F 114, it demodulates the signals, and transmits the demodulated signals to the CPU 101. Thus, the image forming apparatus 100 can communicate, through the network, with the controller 200 (MFP controller) or PC300, which will be described later. Similarly, the network controller 107 receives the signals transmitted from the CPU 101, converts the signals into signals which meet ARCNET (Attached Resource Computer Network) standard, and then, transmits the converted signals to the auxiliary device 118 through the device-to-device communication I/F 113. Further, the network controller 107 receives signals from the auxiliary device 118, demodulates them, and transmits them to the CPU 101.

The examples of the auxiliary device 118 are a finisher as post-processing device, a paper deck as an auxiliary sheet feeding device, and the like.

The image data which the CPU 101 transmits to the printer section 115 through the printer controller section 108 are data of the image to be formed. Therefore, as information written in PDL (Page Description Language) is inputted from the PC 300 into the image forming apparatus 100, each of the CPU 101 and dedicated image processing circuit 106 carries out its share of RIP (Raster Image Processing).

"PDL" is a programming language for instructing the image forming apparatus 100 about the image to be outputted. "PDL" is advantageous in that it makes it possible to store an image in the form of vector data which does not rely on printer resolution, and also that when an image to be formed is a simple line drawing, the image data written in "PDL" is significantly smaller than that written in another language. On the other hand, if "PDL" is used, the data written in "PDL" have to be reconverted into the image map data to which the PDL data has to be converted to be outputted by the printer section. This process is one of the disadvantages of the usage of "PDL." The process of converting the "PDL" data into image data is referred to as RIP (Raster Image Processing).

The image data obtained through the conversion of the "PDL" data by RIP is transmitted to the printer section 115 through the printer controller 108. The printer section 115 outputs a print based on the image data it received through the printer controller 108.

The printer controller 108 can control the printer section 115 so that the toner image on a sheet S of recording medium is fixed in accordance with the image data inputted from an external source. Further, the printer controller 108 can control the printer section 115 through the network controller 107, based on the image data transmitted from an external source.

The scanner controller 109 controls the image reading operation of the image sensor which is under the original placement plate of the scanner section 116. It controls also the operation of the ADF (Automatic Document Feeder) of the scanner section 116. If it is necessary for the image data of multiple originals to be inputted into the image forming apparatus 100, the originals are to be placed one at a time on the original placement plate of the scanner section 116 to be scanned one at a time. As the scanner controller 109 receives a command to read an original, it moves the image sensor (which is under original placement platen) in a manner to scan the original to obtain the image data of the original on the original placement platen. An operator may place two or more originals in the ADF, and instruct the ADF to continuously read all the originals. As the ADF receives the instruction, it sends one of the two or more originals in the ADF onto the original placement platen, which is above the image sensor section. As soon as the first original is read, the ADF sends another original onto the original placement platen from the ADF. The ADF repeats this process of feeding the originals in the ADF one after another until the last original is fed. That is, the ADF makes it possible for multiple originals to be automatically read, freeing thereby the operator from the tedious manual work of placing originals one by one on the original placement platen of the scanner section 116.

In a case where a "box mode", which is the mode for storing images in the HDD 104 in the image forming apparatus 100 is selected, the scanner controller 109 stores the image data (obtained by scanner section 116) in the HDD 104. In a case where the copy mode, which is the mode for outputting the image data (obtained by scanner section 116) with the use of the printer section 115, the scanner controller 109 transmits the image data (obtained by scanner section 116) to the printer controller 108. Then, the printer controller 108 makes the printer section 115 output the received image data.

The I/O controller 110 communicates with the PC 300 or controller 200 through USB, and I/F 117. The I/O controller 110 is in connection to the display 111 and control panel 112. The CPU 101 can obtain, through the I/O controller 110, the information inputted by an operator with use of the control panel 112. Further, the I/O controller 110 makes the display 111 display an information menu, from which an operator can select his or her choice or choices of information, and graphics which show the state of the image forming apparatus 100. As for the information related to this embodiment, such graphics as the one for selecting an area or areas of a print, which an operator wants to be higher in gloss level than the rest of the print are displayed. In addition, the graphics for inputting the information related to the gloss level of the sheet S of recording medium to be used by the image forming apparatus 100 can be displayed, as will be described in detail when the fourth embodiment of the present invention is described layer.

1-2. Scanner Section

Next, the scanner section 116 is described. The scanner section 116 is above the center portion of the printer section 115. As described above, the scanner section 116 has: the image sensor, which is a photoelectric conversion element for reading an original; original placement platen; and ADF (Automatic Document Feeder). The scanner section 116 uses its image sensor to obtain the image data of the original on the original placement platen or the originals in the ADF. The image data of each original obtained by the scanner section 116 is transmitted to the scanner controller 109, which is capable of transmitting, through the bus 105, the image data (obtained by the scanner section 116) to various sections of the image forming apparatus 100 which are in connection to the scanner controller 109 through the bus 105.

1-3. Printer Section

Next, the printer section 115 is described. The printer section 115 of the image forming apparatus 100 in this embodiment forms images with the use of an electrophotographic method. Therefore, the printer section 115 has a recording medium conveying section, image forming means, a fixing section, etc.

The recording medium conveying section has a pair of cassettes 13*a* and 13*b*, a manual feed tray 14, a pair of pickup rollers 11, a pair of conveyance rollers 12, a pair of registration rollers 8, etc. A sheet S of recording medium (sheet of ordinary paper, film, etc.) is stored in the cassette 13*a* or 13*b*. Information such as the gloss level, basis weight, type, or the like attributes of the sheet S of recording medium stored in the cassettes 13*a* and 13*b* can be manually entered with the use of the control panel 112.

The sheets S of recording medium in the cassette 13*a* or 13*b* are moved one by one out of the cassette 13*a* or 13*b* by the pair of pickup rollers 11. Then, each sheet S of recording medium is conveyed further into the main assembly of the image forming apparatus 100 by the pair of recording medium conveyance rollers 12, until it comes into contact with the pair of registration rollers 8, which are rotated in synchronism with the progression of the transfer of a toner image onto the intermediary transfer belt 7. Then, each sheet S is conveyed to the secondary transfer station N2 by the pair of registration rollers 8 with such a timing that its arrival at the secondary transfer station N2 coincides with the arrival of the toner image(s) on the intermediary transfer belt 7 at the secondary transfer station N2.

The image forming means has multiple image formation stations, more specifically, the first, second, third, fourth, and fifth image formation stations PT, PY, PM, PC and PK, respectively, and an intermediary transfer belt unit 70.

A transparent toner image is formed by the first image formation station PT, that is, the image forming station for forming a transparent toner image. Yellow, magenta, cyan, and black toner images are formed by the second, third, fourth, and fifth image formation stations PY, PM, PC and PK, respectively, which are the color image forming stations. The five image formation stations PT, PY, PM, PC and PK are parallel to each other, and are in roughly horizontal alignment in the recording medium conveyance direction. The toner images formed by the image formation stations PT, PY, PM, PC and PK are transferred (primary transfer) onto the intermediary transfer belt 7 of the intermediary transfer belt unit 70. After the transfer of the toner images onto the intermediary transfer belt 7, the toner images are transferred (secondary transfer) onto a sheet S of recording medium.

The first to fifth image formation stations PT, PY, PM, PC, and PK are practically the same in structure and basic operation, although they are different in the type of the toner they use. Hereafter, therefore, they may be described together without showing (unless necessary) the suffixes T, Y, M, C and K of the referential codes, which are for indicating the colors of the images they form.

Each of the image formation stations P has a photosensitive drum 1, that is, an electrophotographic photosensitive member (photosensitive member), as an image bearing member, which is in the form of a drum. The photosensitive drum 1 is rotatably supported by the main assembly of the image forming apparatus 100, by its shaft. It is rotated in the direction (counterclockwise direction) indicated by an arrow mark R1, by the driving force it receives from a motor as a driving means. The image formation station P has: a charge roller 2, that is, a charging member as charging means which is in the form of a roller; a laser scanner 3 as an exposing means; a developing device 4; a primary transfer roller 6 which is the primary transferring member as the primary transferring means which is in the form of a roller; and a drum cleaner 5 as a means for cleaning the photosensitive member. The charge roller 2, laser scanner 3, developing device 4, primary transfer roller 6, and drum cleaner 5 are in the adjacencies of the peripheral surface of the photosensitive drum 1, and are in the listed order in terms of the rotational direction of the photosensitive drum 1.

The intermediary transfer belt unit 70 has the intermediary transfer belt 7 which is an endless belt positioned so that it faces all the photosensitive drums 1T, 1Y, 1M, 1C and 1K of the first to fifth image formation portions PT, PY, PM, PC and PK, respectively. The intermediary transfer belt 7 is supported and kept stretched by multiple supporting members, more specifically, a follower roller 71, a belt backing roller 72, and a driving roller 73. The follower roller 71 doubles as a tension roller. It is rotated by the movement of the intermediary transfer belt 7 while providing the intermediary transfer belt 7 with a preset amount of tension. The primary transfer rollers 6 are on the inward side of the loop which the intermediary transfer belt 7 forms. They oppose the corresponding photosensitive drums 1, one for one. More specifically, each primary transfer roller 6 presses the intermediary transfer belt 7 upon the corresponding photosensitive drum 1, forming thereby a primary transfer station N1 (primary transfer nip), in which the intermediary transfer belt 7 is in contact with photosensitive drum 1). The intermediary transfer belt unit 70 has also a secondary transfer roller 9 as the secondary transferring member, which is the second transferring member in the form of a roller. The secondary transfer roller 9 is pressed against the belt backing roller 72, with the presence of the intermediary transfer belt 7 between itself and the belt backing roller 72, whereby it forms the secondary transfer station N2 (secondary transfer nip), in which the intermediary transfer belt 7 is in contact with the secondary transfer roller 9). The belt driving roller 73 is rotated by the driving force which it receives from a motor as a belt driving means. The intermediary transfer belt 7 is circularly moved (rotated) in the direction (clockwise direction) indicated by an arrow mark R2 by the driving force which it receives from the belt driving roller 73.

Next, the image forming operation of the image forming apparatus 100 is described with reference to a case in which all of the first to fifth image formation stations PT, PY, PM, PC and PK are used, in combination with the single-pass image formation method, which will be described later in detail. In each image formation station P, the peripheral surface of the photosensitive drum 1 is uniformly charged to a preset potential level by the charge roller 2. Then, the image formation signals for forming an image of one of the toners, different in color, are inputted from the printer controller 108 into the laser scanner 3. Then, the laser scanner 3 scans (exposes) the uniformly charged area of the peripheral surface of the photosensitive drum 1, with the beam of laser light which it projects while modulating the beam with the inputted image formation signals. As a given point of the uniformly charged area of the peripheral surface of the photosensitive drum 1 is exposed, its charge is neutralized. Consequently, an electrostatic latent image (electrostatic image) is effected on the peripheral surface of the photosensitive drum 1. Then, the electrostatic latent image is developed by the developing device 4 into a toner image, that is, an image formed of toner. Then, the toner image is moved, by the rotation of the photosensitive drum 1, to the primary transfer station N1, in which the toner image is transferred (primary transfer) onto the intermediary transfer belt 7 (as image conveying member) by the function of the primary transfer roller 6. During the primary transfer of the toner image, the primary transfer voltage (primary transfer bias), which is opposite in polarity to the intrinsic charge of the toner, is applied to the primary transfer roller 6 from the primary transfer power source (high voltage power source) as the primary transfer voltage applying means. The toner remaining on the photosensitive drum 1 (primary transfer residual toner) after the primary transfer, that is, the toner which was not transferred onto the intermediary transfer belt 7 in each primary transfer station N1, is recovered by the drum cleaner 5.

First, a transparent toner image is formed on the photosensitive drum 1 in the first image formation station PT as described above, and is transferred (primary transfer) onto the intermediary transfer belt 7. Thereafter, four toner images are formed on the photosensitive drums 1 in the second, third, fourth, and fifth image formation stations PY, PM, PC and PK, one for one, and are sequentially transferred (primary transfer) in layers onto the intermediary transfer belt 7.

As described previously, the structure of the first image formation station PT is the same as those of the second to fifth image formation stations PY, PM, PC and PK, although it is different in the toner in the developing device 4. Therefore, the image formation station PT can form a transparent toner image in response to the image formation signals inputted into the laser scanner 3T of the first image formation station PT. Thus, the first image formation station PT can be used to form a transparent image in such a manner that the transparent toner image entirely or partially cover the sheet S of recording medium.

After the transfer of the toner images onto the intermediary transfer belt 7, the toner images are conveyed by the movement of the intermediary transfer belt 7 to the secondary transfer station N2, in which they are transferred together by the function of the secondary transfer roller 9 and belt backing roller 72, onto the sheet S of recording medium which is conveyed through the secondary transfer station N2 by the aforementioned recording medium conveying section. While the toner images on the intermediary transfer belt 7 are conveyed through the secondary transfer station N2, the secondary transfer voltage (secondary transfer bias), which is opposite in polarity from the intrinsic electric charge of the toner, is applied to the second transfer roller 9. Incidentally, the image forming apparatus 100 may be structured so that the secondary transfer voltage which is the same in polarity as the intrinsic electric charge of the toner is charged to the belt backing roller 72. The toner (secondary transfer residual toner) remaining on the intermediary transfer belt 7 after the secondary transfer, that is, the toner which was not transferred onto the sheet S of recording medium in the secondary transfer station N2, is recovered by the belt cleaner 74, which is on the downstream side of the secondary transfer station N2 (and upstream side of primary transfer station N1T of primary image formation station PT) in terms of the moving direction of the image bearing surface of the intermediary transfer belt 7.

After the transfer of the toner images onto the sheet S of recording medium, the sheet S is conveyed to the fixation section, which is described later.

A transparent toner image is formed by the first image formation station PT. It is the first toner image that is transferred onto the intermediary transfer belt 7. Therefore, in an image forming operation in which transparent toner is used, a transparent toner image is the topmost layer (image) on the sheet S of recording medium.

On the other hand, in an image forming operation in which transparent toner is not used, that is, an image forming operation in which only color toners are used for image formation, an image is formed in the following manner. Generally, an image is formed on the photosensitive drum 1 in at least one of the second to fifth image formation stations PY, PM, PC and PK. That is, one or more color toner images are formed. Then, the toner image or toner images are transferred (primary transfer) onto the intermediary transfer belt 7, and then, are transferred (secondary transfer) onto the sheet S of recording medium. In other words, the image forming apparatus 100 is capable of forming a full-color image using all of the second to fifth image formation stations PY, PM, PC and PK, or a monochromatic image using only one of them, for example, the fifth image formation station PK.

The image forming operation for forming an image using only the transparent toner is the same as that for forming an image using one of the second to fifth image formation stations PY, PM, PC and PK. That is, a toner image is formed in the first image formation PT, is transferred (primary transfer) onto the intermediary transfer belt 7, and then, is transferred (secondary transfer) onto the sheet S of recording medium.

The fixation section has a fixing device 10, as a fixing means, which applies heat and pressure to the sheet S of recording medium and the toner images (s) thereon to fix the toner image(s). The fixing device 10 has a fixation roller 10*a* and a pressure roller 10*b*, which are kept pressed upon each other, forming thereby a fixation station N3 (fixation nip) between them. In this embodiment, both the fixation roller 10*a* and pressure roller 10*b* are 80 mm in external diameter, and 350 mm in length in terms of the direction parallel to their rotational axes. The fixation roller 10*a* is rotationally supported by the external walls of the fixing device 10, with the presence of a pair of bearings between the lengthwise ends of the axle of the fixation roller 10*a* and the external walls. The pressure roller 10*b* also is rotationally supported by the external walls of the fixing device 10, with the presence of a pair of bearings between the axle of the pressure roller 10*b* and the external walls. The pair of bearings by which the axle of the pressure roller 10*b* is rotationally supported are movable in the direction perpendicular to the axial line of the fixation roller 10*a*, and are under the pressure generated by a pair of springs as pressure applying means in the direction of the fixation roller 10*a*. Thus, the pressure roller 10*b* is kept pressed upon the fixation roller 10*a* by 500N of pressure.

The fixation roller 10*a* comprises: a hollow metallic core made of aluminum; a rubber layer as an elastic layer; and a fluorinated resin layer as a parting layer. More specifically, the rubber layer is formed on the peripheral surface of the metallic core, and the parting layer is layered on the rubber layer. The fixing device 10 has also a halogen heater (as heat source), which is in the hollow of the metallic core. The material for the hollow metallic core may be a substance other than aluminum. For example, it may be iron. Further, the heat source may be a heater based on electromagnetic induction. The fixation roller 10*a* is in connection to a driving motor (as driving means) through a gear train. It is rotated by the rotational force transmitted thereto from a motor through the gear train.

The structure of the pressure roller 10*b* is similar to that of the fixation roller 10*a*. That is, it comprises: a hollow metallic core; a rubber layer layered on the peripheral surface of the metallic core; and a fluorinated rubber layer layered on the rubber layer. There is a halogen heater in the hollow of the metallic core. The pressure roller 10*b* is rotated by the rotation of the fixation roller 10*a*.

The fixing device 10 is provided with a pair of thermistors as means for detecting the temperature of the fixation roller 10*a* and pressure roller 10*b*, one for one. One of the thermistors is in the adjacencies of the peripheral surface of the fixation roller 10*a*, and the other is in the adjacencies of the peripheral surface of the pressure roller 10*b*. The temperature signals outputted from each thermistor are sent to the printer controller 108, and are used by the printer controller 108 to control the fixation roller 10*a* and pressure roller 10*b* in temperature.

In this embodiment, the printer controller 108 controls the halogen heater in the fixation roller 10*a* so that the surface temperature of the fixation roller 10*a* becomes 155° C. (target level) and remains at the target level. It controls also the halogen heater in the pressure roller 10*b* so that the surface temperature of the pressure roller 10*b* becomes 100° C. (target temperature) and remains at the target temperature.

When the image forming apparatus 100 is in the single-pass image formation mode (which is described later in more detail), the sheet S of recording medium is conveyed through the fixation station N3 after a toner image or toner images are transferred onto the sheet S in the secondary transfer station N2. After the fixation of the toner image(s) on the sheet S, the sheet S is discharged from the image forming apparatus 100 through the sheet conveyance passage.

When the image forming apparatus 100 is in the double-pass image formation mode (which is described later in more detail), the sheet S of recording medium is not introduced into a turnover pass 15*c* after it is put through the first fixation process. Instead, it is conveyed again to the secondary transfer station N2 through recording medium conveyance passages 15*a* and 15*b*. Then, a transparent toner image is transfer onto the sheet S in the secondary transfer station N2, and the sheet S is conveyed through the fixation station N3 for the second time, whereby the transparent toner image is fixed to the sheet S. Thereafter, the sheet S is discharged from the image forming apparatus 100 through the recording medium conveyance passage.

Further, when the image forming apparatus 100 is in the ordinary two-sided mode, the sheet S of recording medium is introduced into the turnover path 15*c* after being put through the first fixation process. Then, it is conveyed to the second transfer station N2 through the recording medium conveyance passages 15*a* and 15*b* so that an image or images are formed on the opposite surface of the sheet S from the surface on which an image or images were transferred when the sheet S was put through the second transfer station N2 for the first time.

Also in this embodiment, the fixing device 10 heats the sheet S of recording medium so that when the sheet S is discharged from the fixing device 10 right after being conveyed through the fixation station N3 of the fixing device 10, its temperature is still in a range of roughly 90-110° C. However, the temperature of the sheet S when the sheet S is discharged from the fixing device 10 is affected by the fixation condition, basis weight of the sheet S, and the like factors.

Further, in this embodiment, the fixing device 10 has the pair of rollers, that is, the fixation roller 10*a* and pressure roller 10*b*. However, it may be structured so that one or both of the two rollers are an endless belt. Further, regarding the fixation method, the choice of the fixation method for the fixing device 10 does not need to be limited to one of those which use heat and pressure. All that is required of the fixing device 10 is for the fixing device 10 to have at least a means for heating an unfixed toner image.

2. Toner

Next, the toners used in this embodiment are described. In the description of the preferred embodiments of the present invention, a term "color toner" is a generic term for yellow, magenta, cyan and black toners, that is, all the toners except for the transparent toner used by the image forming apparatus 100 in this embodiment.

The transparent toner and color toners used by the image forming apparatus 100 in this embodiment are polyester toners. As the methods for manufacturing these toners, a pulverization method and a method for directly forming toner in a medium can be listed. The examples of the second method are a suspension polymerization method, an interfacial polymerization method, a disperse polymerization method, and the like. However, the toner ingredient and toner manufacturing method do not need to be limited to those listed above.

To describe in more detail, the color toners are made up of primarily polyester resin and pigment. The transparent toner is made up of primarily polyester resin; it does not contain pigment. As the transparent toner, particles of such resin that is high in transparency, practically free of coloring agents, practically colorless, and capable of passing at least visible light without dispersing it in practical terms, are preferable. However, such particles that become practically colorless and transparent as they are put through the fixation process may be used as the transparent toner. That is, before the fixation, the particles which are used as the transparent toner do not need to be colorless and transparent. Further, before the fixation, they may appear white.

In this embodiment, both the transparent toner and color toner are roughly 55° C. in glass transition temperature point (Tg). That is, the transparent toner was manufactured so that its glass transition point became roughly the same as that of the color toner. Therefore, if a color toner image and a transparent toner image are roughly the same in the toner amount per unit area, and are fixed under the same fixation condition, the two are roughly the same in gloss level after their fixation to the sheet S of recording medium.

Needless to say, the glass transition point (Tg) for the toners to be used by the image forming apparatus 100 in this embodiment does not need to be limited to the one. The characteristics of transparent toner, more specifically, the glass transition point of transparent toner and how transparent toner melt, are affected by the type of the resin of which the transparent toner is made and its molecular weight. Therefore, if two toner images which are different in the characteristics of the toners of which they are made are fixed to the sheet S of recording medium under the same fixation condition, they become different in gloss level. Thus, using such resin that is lower in glass transition point (Tg), being therefore easier to melt, than the resin used as the material for a color toner, makes it possible to manufacture a transparent toner which is higher in gloss than the color toner after the fixation. On the other hand, using such resin that is higher in glass transition point (Tg), being therefore more difficult to melt, than the resin used as the material for a color toner, makes it possible to manufacture a transparent toner which is lower in gloss than the color toner after the fixation. The transparent toner used by the image forming apparatus 100 in this embodiment may be different in glass transition point (Tg) from the color toners used by the apparatus 100.

3. Gloss Adjustment

Next, the method for adjusting the image forming apparatus 100 in the gloss level at which the gloss level of a selected or selected areas of an image will be as the image is outputted by the apparatus 100 is described. The image forming apparatus 100 can operate in the image formation mode (transparent image formation mode) in which it can output a print, the selected area or areas of the image formation areas of which are different in gloss level from the rest. In the transparent image formation mode, a transparent image is layered on the color image(s) on the sheet S of recording medium to cover the selected area or areas of the sheet S with a layer of transparent toner, so that as the layered toner images on the sheet S are fixed, the area or areas of the sheet S covered with the layer of transparent toner become different from the rest in gloss level. For example, this mode makes it possible for the image forming apparatus 100 to output a print, the selected area or areas of the sheet S of recording medium of which are higher in the gloss level of the patterns and letters of the color image than the rest, and therefore, appear as if covered with a sheet of a transparent substance.

When the image forming apparatus 100 is in the transparent toner image formation mode, it can be selectively operated in the first or second mode (sub-mode). In the first mode, an image is formed with the use of the single-pass image formation method, whereas in the second mode, an image is formed with the use of the double-pass image formation method. As described above, in the single-pass method, a color toner image (or color toner images) and a transparent toner image are formed on the sheet S of recording medium, and the sheet S of recording medium is put through the fixation process only once before the sheet S is discharged from the apparatus 100. In comparison, in the double-pass method, the sheet S and the color toner image (or images) thereon are subjected to the fixation process twice. More specifically, before the sheet S is subjected to the fixation process for the first time, only a color toner image (or color toner images) is formed on the sheet S. Then, after the first fixation process, a transparent toner image formed on the sheet S having the fixed color toner image (images), and the sheet S having the fixed color toner image (images) and unfixed transparent toner image is put through the fixation process. In this embodiment, whether the single-pass method or the double-pass method is used in the transparent image formation mode is determined by the density (toner amount per unit area) of the color image (images) formed in the transparent image formation mode. This arrangement makes it easier to make the image forming apparatus 100 to output a print, the selected area or areas of the image formation area of the sheet S of recording medium of which are different in gloss level from the rest.

Incidentally, it is possible to make the image forming apparatus 100 output such a print that pictures and/or letters on the selected area or areas of the sheet S are lower in gloss level than those on the rest. However, such an image forming operation of the image forming apparatus 100 may be thought to be the same as the one for outputting a print, the selected area or areas of the sheet S of recording medium of which are higher in gloss level than the rest. Thus, in order to make it easier to understand the present invention, "making a selected area or selected areas of the image formation area of a sheet S of recording medium different in gloss level from the rest" in the following description of the preferred embodiments of the present invention means "making a selected area or selected areas of the image formation area of a sheet S of recording medium higher in gloss level than the rest". Of course, it is possible to make the image forming apparatus 100 output a print, the area or areas of which selected by an operator are lower in gloss level than the rest, for example, in a case where selecting the area or areas of the sheet S of recording medium where specific patterns and letters are concentrated is more convenient to an operator than selecting the rest, in the transparent toner image formation mode (which is described later in more detail). In such a case, all that is necessary is to make the image forming apparatus 100 carry out the same image forming operation except that the area other than the area selected as the area to be lower in gloss level is to be treated as the area to be higher in gloss level, as will be described later.

3-1. Relationship Between Amount of Color Toner Per Unit Area and Gloss Level

First, the relationship between the amount of the color toner(s) per unit area of a given area of a print and the gloss level of the given area is described.

In the following description of the preferred embodiments of the present invention, "gloss level of a print" means the gloss level of a print measured with the use of a Handy Glossimeter PG-1M (product of Nippon Denshoku Co., Ltd.), in 60 degree gloss measurement mode which is in accordance with the mirror surface gloss level measuring method JIS Z 8741.

The list of the various conditions which affect the level at which the gloss of the image bearing surface of the sheet S of recording medium will be after the sheet S is put through the fixation process are as follows.

Recording medium used for testing the image forming apparatus 100 in this embodiment was matte coated paper, more specifically, "U-light (registered commercial name) (product of Nippon Paper Industries Co., Ltd.) which is 157 g/m$^2$ in basis weight.

The printer controller 108 controls the printer section 115 so that the amount by which toner is placed on the sheet S of paper per unit area as an electrical signal which corresponds to an image density of 100% is inputted becomes roughly 0.55 mg/cm$^2$ regardless of toner type. That an image is 100% in toner density means that the tone density of the image corresponds to the highest level of the density level signal (256 levels (gradations)). Hereafter, the amount of the toner per unit area of the sheet S of recording medium (which may be referred to simply as "toner amount") is stated as its ratio relative to the maximum amount, that is, 0.55 mg/cm$^2$, by which each toner can be adhered to the sheet S. The image forming apparatus 100 in this embodiment is controlled so that the maximum amount by which the color toner (toners) are adhered to the sheet S per unit area of the sheet S to form a color image becomes 250%. Further, in the transparent image formation mode, it is controlled so that the amount (transparent toner amount) by which the transparent toner is adhered to the sheet S per unit area remains at 70% (0.39 mm/cm$^2$).

Further, the printer controller 108 controls the fixing device 10 so that the surface temperature of the fixation roller 10*a* becomes roughly 155° C. and remains at this level. Further, it controls printer section 115 so that the speed (process speed, which corresponds to peripheral velocity of fixation roller 10*a*) at which the sheet S of recording medium moves through the fixing device 10 becomes 285 mm/sec). In an image forming operation in which the double-pass image formation method is used, the first and second fixation processes are the same in the process speed (285 mm/sec) and the target temperature (155° C.). As for the amount of contact pressure between the fixation roller 10*a* and pressure roller 10*b* in the fixation nip N3, it is kept practically the same regardless of whether an image is formed using the single-pass method or double-pass method.

As described above, polyester resin is used as one of the materials for both the color toners and transparent toner used by the image forming apparatus 100 in this embodiment. Further, both the color toners and transparent toner are roughly 55° C. in glass transition temperature (Tg).

(Single-pass Image Formation Method)

Figure 3:
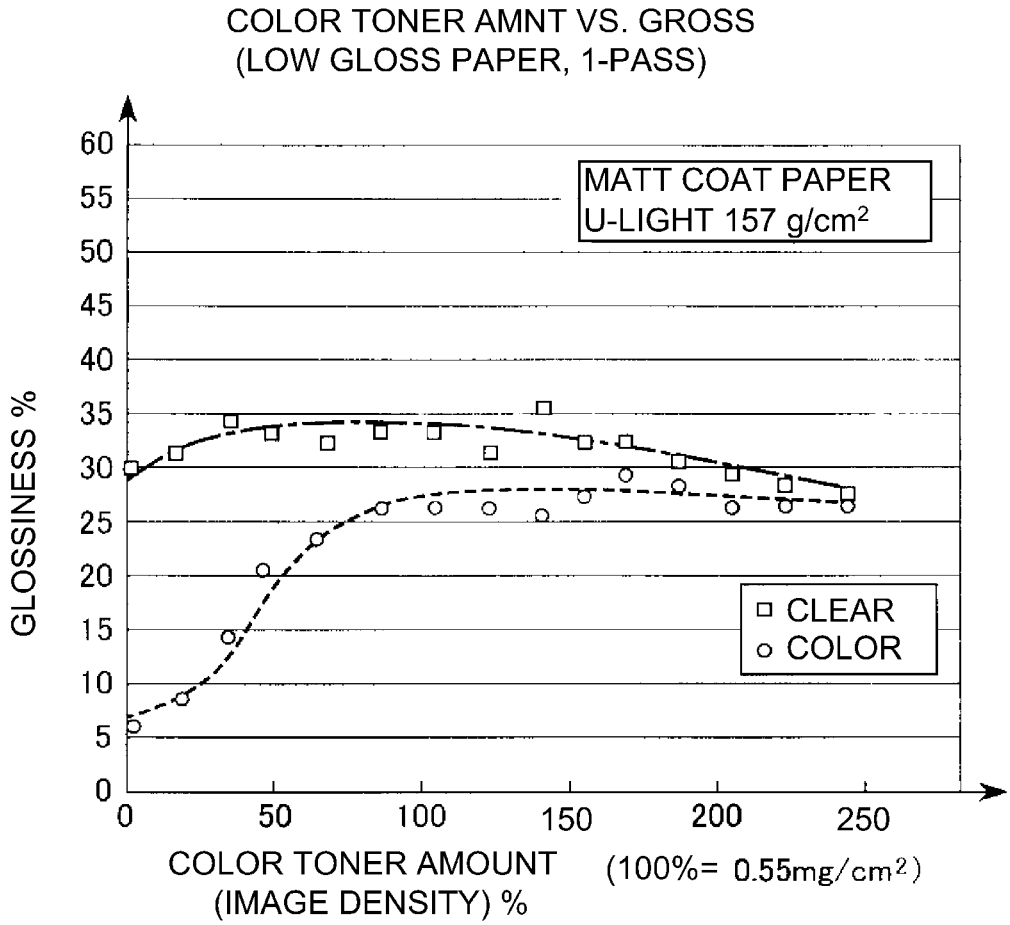
FIG. 3 is a graph showing the relationship between the amount (per unit area) of the color toner on a given area of a sheet of recording medium, and the gloss level of the given area after fixation, when a color print was made with the use of a sheet of low gloss paper and the single-pass image formation method, in the transparent image formation mode.

FIG. 3 is a graph which shows the relationship between the amount of the color toner on a given area of the image bearing surface of the sheet S of recording medium, and the gloss level of the given area after fixation, when the single-pass image formation mode was used. The vertical axis of the graph stands for the gloss level, and the horizontal axis stands for the amount of color toner on a given area of the image bearing surface of the sheet S of recording medium.

The curved broken line in FIG. 3 represents the relationship between the amount of color toner on a given area of the image bearing surface of the sheet S of recording medium, and the gloss level of the given area, when only a color toner image was formed on the sheet S and fixed to the sheet S through one fixation process. The curved single-dot chain line in FIG. 3 represents the relationship between the amount of color toner on a given area of the image bearing surface of the sheet S, and the gloss level of the given area, when a color toner image, and a transparent toner image which was 70% in toner amount, were formed on the given area of the sheet S and were fixed to the sheet S through one fixation process.

It is evident from FIG. 3 that in the color toner amount range in which the color toner amount was no less than 100%, in particular, no less than 150%, the areas of a print, which were made up of only the color toners, and the areas of the print, which were made up of the color toner images and the transparent toner image (which was 70% in toner amount) are not substantially different in gloss level. That is, in the color toner amount range in which the color toner amount is no less than 100%, in particular, no less than 150%, it is difficult to make the selected area or areas of the image formation area of the sheet S of recording medium, different in glossiness from the rest by using the single-pass image formation method.

(Double-pass Image Formation Method)

Figure 4:
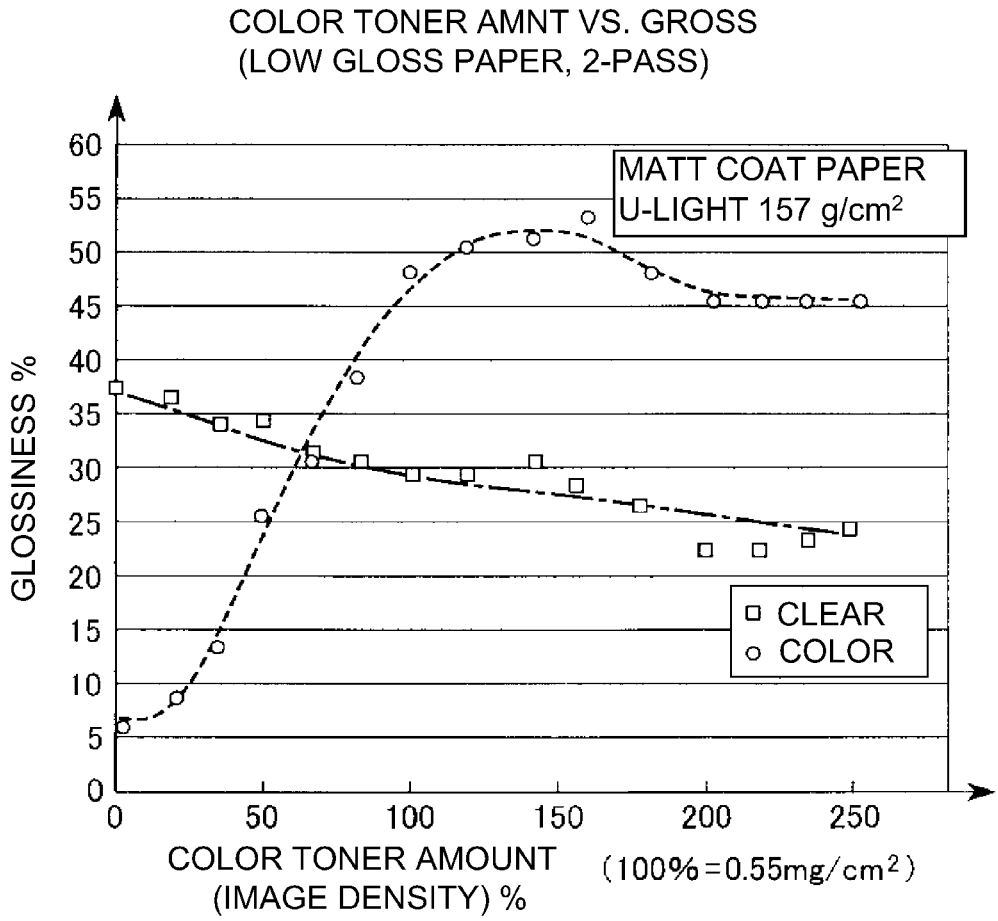
FIG. 4 is a graph showing the relationship between the amount (per unit area) of the color toner on a given area of a sheet of recording medium, and the gloss level of the given area after fixation, when a color print was made with the use of a sheet of low gloss paper and the double-pass image formation method, in the transparent image formation mode.

FIG. 4 is a graph which shows the relationship between the amount of the color toners on a given area of the image bearing surface of the sheet S of recording medium, and the post-fixation gloss level of the given area when the double-pass image formation method was used. The vertical axis of the graph stands for the gloss level after the completion of the double-pass image formation method, and the horizontal axis stands for the amount of the color toners on a given area of the image bearing surface of the sheet S of recording medium.

The curved broken line in FIG. 4 represents the relationship between the amount of the color toners on a given area of the image bearing surface of the sheet S of recording medium, and the gloss level of the given area, when only a color toner image was formed on the sheet S and fixed to the sheet S through the first fixation process, and then, the sheet S and the fixed color toner images thereon were subjected to the second fixation process. The curved single-dot chain line in FIG. 4 represents the relationship between the amount of color toner on a given area of the image bearing surface of the sheet S, and the gloss level of the given area, after color toner image was formed on the sheet S; the image was fixed to the sheet S through the first fixation process; a transparent toner image, which was 70% in toner amount, formed on the sheet S so that it covered the fixed color toner images on the sheet S; and then, the sheet S and the toner images thereon (fixed color toner images and unfixed transparent toner image) were put through the second fixation process.

Paying attention to the gloss levels represented by the broken line and single-dot chain line in FIG. 4, an area of the color image, which was 150% in color toner amount, and which was not covered with the transparent toner of a transparent toner image, became 50% in gloss level, because the color toner on the area was subjected to the fixation process twice. On the other hand, an area of color image, which was covered with the transparent toner of the transparent toner image which was 70% in toner amount, became 29% in gloss level, because the transparent toner image was subjected to the fixation process only once.

Referring to the curved broken line in FIG. 4, in a case where the color toner amount was 0%, that is, in a case where a color toner image was not formed, an area of the sheet S of recording medium, which was not covered with the transparent toner of a transparent toner image, was the same as the gloss level (6%) of the sheet S itself after the second fixation process. In comparison, the single-dot chain line in FIG. 4 shows the gloss level when a transparent toner image which was 70% in toner amount was formed. Referring to the curved single-dot chain line in FIG. 4, the point of the curved single-dot chain line, which corresponds to where the color toner amount is 0%, shows the gloss level of a given point of the sheet S of recording medium, after it was subjected to the first fixation process without the formation of a color toner image (without being covered with the color toner), and then, was subjected to the second fixation process after the formation of a transparent toner image which was 70% in toner amount (after being covered with transparent toner). As will be described later when the second embodiment of the present invention and thereafter are described, the matte coat paper used in this embodiment is the so-called low gloss paper. Thus, in a case where only a transparent toner image which is 70% in toner amount is formed on a sheet S of the paper used as the recording medium in this embodiment, and fixed, an area of the sheet S covered with the transparent toner becomes higher in gloss level than the gloss level of the sheet S itself.

On the area of the sheet S of recording medium, on which a transparent image is formed not to cover a color image (broken line in FIG. 4), the surface of the color toner image is subjected to heat twice by the fixing device 10. In comparison, on the area of the sheet S, on which a transparent image is formed to cover the color image (single-dot chain line), the transparent toner image, which makes up the surface layer, is subjected to heat only once. Thus, the area of the sheet S covered with the transparent toner of the transparent image is unlikely to become distinctively higher in gloss level.

It is evident from FIG. 4 that in a color toner amount range in which color toner amount is 50%-80%, a given area of the sheet S of recording medium covered with only color toner is not going to be significantly different in gloss level from another area of the sheet S covered with color toner and the transparent toner of a transparent toner image which is 70% in toner amount. That is, in a color toner amount range in which the color toner amount is 50%-80%, it is difficult to produce a print, the selected area or areas of the image formation area of the sheet S of recording medium of which are different in gloss level from the rest, with the use of the double-pass image formation method.

As described above, there is a color toner amount range in which it is difficult to produce a print, the selected area or areas of the image formation area of the sheet S of which are distinctively different in gloss level from the rest, regardless of whether the single-pass image formation method is used or the double-pass image formation method. Under the image formation condition in this embodiment, as long as the color toner amount is no more than 100%, it is easier to produce a print, the selected area or areas of which are different in gloss level from the rest, with the use of the single-pass image formation method, than the double-pass image formation method. On the other hand, in a case where the color toner amount is no less than 100%, it is easier to produce a print, the selected area or areas of which are significantly different in gloss level from the rest, with the use of the double-pass image formation method, than the single-pass image formation method.

For example, in a case where a print which is roughly 70% in the color toner amount is produced, it is difficult to produce the print so that a selected area or selected areas of the print are significantly different in gloss level from the rest, with the use of the double-pass image formation method, than the single-pass image formation method. On the other hand, in a case where a print which is roughly 150% in the color toner amount is produced, it is difficult to produce the print so that a selected area or selected areas of the print are distinctively different in gloss level from the rest, with the use of the double-pass image formation method, than the single-pass image formation method.

In this embodiment, therefore, whether the single-pass image formation method (color toner image and transparent image are to be fixed together, or double-pass image formation method (color toner image is fixed first; transparent image is formed on fixed color toner image; and transparent image is fixed) is to be used is determined based on the amount of toner (image density) of the color image. Therefore, it is possible to produce a print, the area or areas of the sheet S of recording medium of which selected by a user are sufficiently different in gloss level from the rest.

Figure 14:
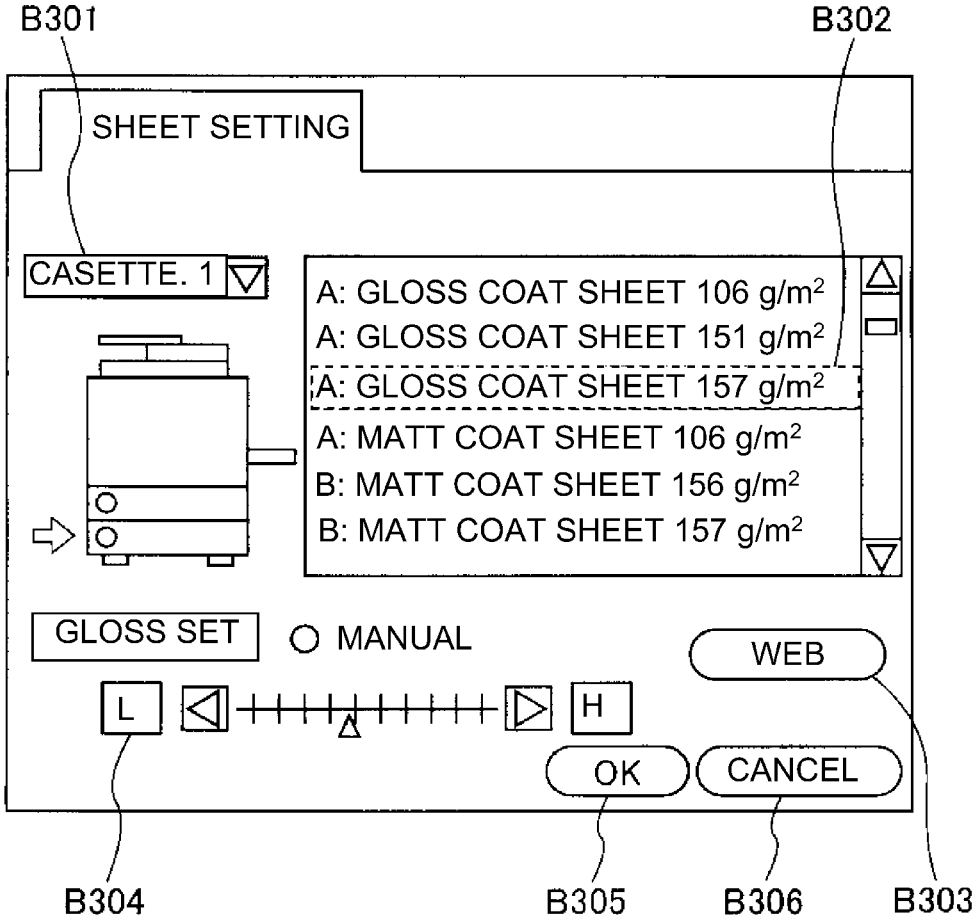
FIG. 14 is an example of the graphics which appear on the display of the image forming apparatus in the first embodiment of the present invention.

For example, in the case represented by FIG. 4, as long as the color toner amount is no more than 50%, an area of the sheet S of recording medium covered with color toner becomes sufficiently different, in gloss level, from an area of the sheet S covered with both color toner and the transparent toner of a transparent toner image which is 70% in toner amount, as the sheet S is put through the final fixation process. The relationship between the color toner amount and gloss level is affected by the type of recording medium (sheet S). That is, in the case of some types of recording medium (sheet S), even if the color toner amount is small, it is possible to produce a print, the selected area or areas of which are distinctly different in gloss level from the rest, as shown in FIG. 14. This phenomenon is described later in more detail in the description of the second embodiment and thereafter. However, when the single-pass image formation method is used, it is unnecessary to convey the sheet S of recording medium through the fixing device 10 twice. Thus, the single-pass image formation method is greater in image output per unit length of time than the double-pass image formation method (greater in printing speed). Thus, the single-pass method is advantageous over the double-pass method, provided that the conditions under which a print is produced is such that the two methods are the same in the amount of difference in the selected area or areas of the sheet S of recording medium of a resultant print and the rest. Therefore, it is advantageous to determine whether the single-pass image formation method or double-pass image formation method is to be used, with reference to a specific threshold value for the color toner amount (100%, for example, in FIGS. 3 and 4). This strategy is advantageous from the standpoint of the simplification of apparatus control. However, this embodiment is not intended to limit the present invention in scope. That is, two or more threshold values may be provided for the color toner amount, so that more latitude is afforded in switching between the single-pass image formation method and double-pass image formation method. More concretely, referring to the image forming operations represented by FIGS. 3 and 4, the image forming apparatus 100 may be designed so that when the color toner amount is in a range of 0%-50%, the double-pass method is used; when the color toner amount is in a range of 50%-100%, the single-pass method is used; and when the color toner amount is no less than 100%, double-pass method is used.

3-2. Operation for Setting Transparent Image Formation Mode

Next, the operation for setting the transparent image formation mode is described. In the operation for setting the transparent image formation mode, an operator is to selected a specific area or specific areas of the image formation area of the sheet S of recording medium, and instruct the image forming apparatus to output a print, the selected area or areas of the image formation area of the sheet S of which are different in gloss level from the rest. Hereafter, the information about the instruction for making the image forming apparatus to output a print, the area or areas of the image formation area of the sheet S of which were different in gloss level from the rest, may be referred to simply as "transparent toner image formation setting information". Further, the area or areas of the image formation area of the sheet S of recording medium, which were selected as the areas to be made different in gloss level from the rest may be referred to as "gloss level adjustment areas".

As described above, in this embodiment, when it is necessary to output a print, the area or areas of the image formation area of the sheet S of recording medium of which selected by an operator are higher in gloss level than the rest, transparent toner is given to the gloss level adjustment area. However, it is possible to reduce in gloss level the area selected by the operator.

Figure 5:
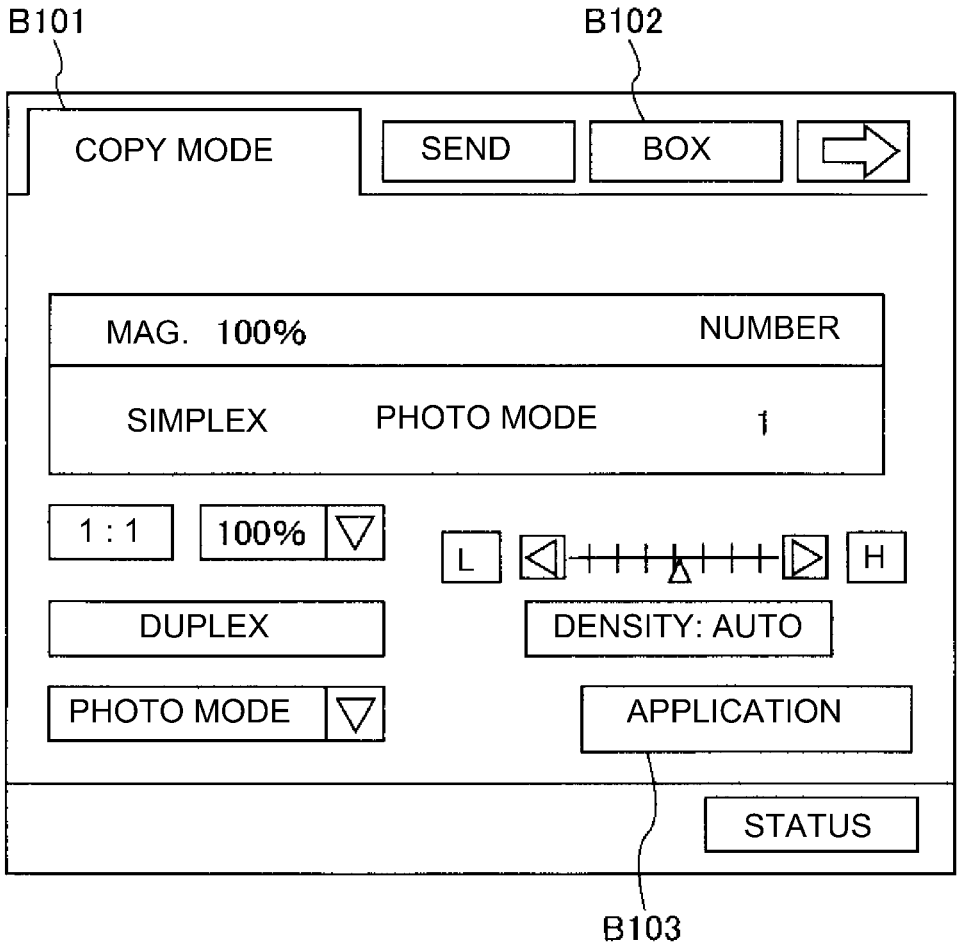
FIG. 5 is an example of the graphics which appear on the display of the image forming apparatus in the first preferred embodiment of the present invention.

FIG. 5 is an example of a graphics displayed on the display 111. As the start key (unshown), with which the control panel 112 is provided, is pressed by an operator when the graphic shown in FIG. 5 is on the display, that is, when the image forming apparatus 100 is in the copy mode, the image forming apparatus 100 copies the original on its original placement platen.

If an icon B102 of the graphics shown in FIG. 5, which is named "box", is selected by the operator, the image forming apparatus 100 is switched in operational mode to the box mode, in which the operator can output, in the form of an image, the data stored in the internal HDD 104 of the image forming apparatus 100, with the use of its printer section 115. If an icon B101 of the graphics shown in FIG. 5, which is named "copy mode" is selected by the operator, the image forming apparatus 100 is switched in operational mode from the box mode to the copy mode.

Further, when the graphics shown in FIG. 5 is on the display 111, the operator can select the icon B103 named "secondary printer setting". As the operator selects the icon (unshown) which is displayed on the display 111 and is named "transparent image formation setting", the image forming apparatus 100 displays the graphics shown in FIG. 6 on its display 111.

Figure 6:
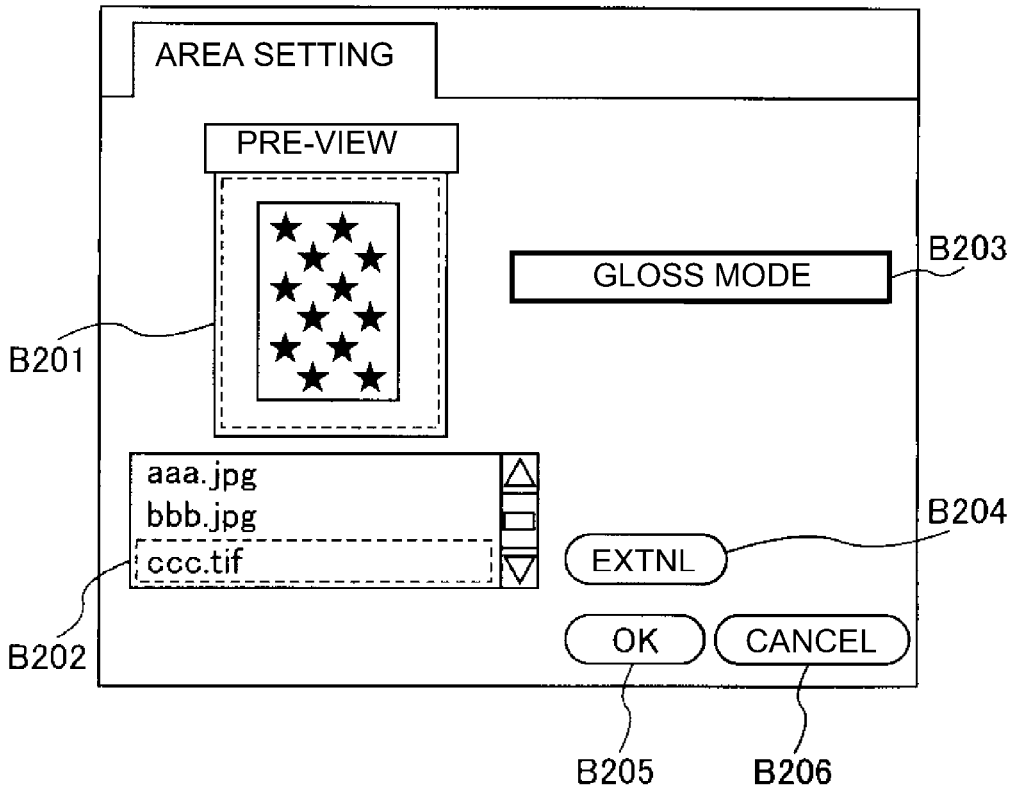
FIG. 6 is another example of the graphics which appear on the display of the image forming apparatus in the first embodiment.

FIG. 6 is an example of the graphics which is for prompting the user to input the transparent image formation settings. The image forming apparatus 100 displays the graphics such as the one shown in FIG. 6, on its display 111, whereby the image forming apparatus 100 can obtain the transparent image formation settings, which are to be inputted by the operator.

An icon B201 of the graphics shown in FIG. 6 is for previewing the gloss adjustment areas to be selected by the user. Within the icon B201, the gloss adjustment areas are indicated by "black star". The rectangle which is drawn in a solid line and surrounds the black stars, corresponds to the image formation area of the sheet S of recording medium. More concretely, in this embodiment, each area covered with "black star" can be made higher in gloss level than the rest of the image formation area of the sheet S, to obtain such an effect that the "black star" appears like a transparent cover. Hereafter, each of the gloss adjustment areas (covered by "black star" in FIG. 6) may be referred to as "marked area". Further, the other areas of the image formation area of the sheet S than the marked areas may be referred to as "background areas".

An icon B202 of the graphics shown in FIG. 6 is for selecting the image files stored in the HDD104 of the image forming apparatus 100. The operator is to choose the gloss level adjustment areas (areas to be marked) from the list in the icon B202.

FIG. 6 shows that a file [ccc.tif] has just been selected. For example, this image file named [ccc.tif] prescribes multiple "black stars" to be placed in the image formation area of the sheet S, and the locations therefore on the sheet S.

As for an icon B204 of the graphics shown in FIG. 6, which is named "external reference", it is for opening the graphics for choosing the file for selecting the gloss adjustment areas (areas to be marked) through the network. Thus, it is possible to select the areas of the sheet S, which are to be adjusted in gloss, with the use of one of the files other than those stored in the image forming apparatus 100, that is, the files usable through the network.

An icon B203 named "gloss mode" in the graphics shown in FIG. 6 is an icon for instructing the image forming apparatus 100 to output a print, the areas of which corresponding to the gloss adjustment areas are different in gloss level from the rest. As an operator selects the icon B203, the CPU (as means for obtaining transparent image formation settings) obtains the transparent image formation settings set by the operator. More specifically, the CPU 101 functions as the means for obtaining the information of the areas of the sheet S, which are to be adjusted in gloss level. Further, it functions also as the means for obtaining the information of the instruction for making the gloss adjustment areas of the image formation area of the sheet S, different in gloss level from the rest.

As described above, in this embodiment, as an operator selects the icon B202 (or B204) to select the image file for selecting the gloss adjustment areas, and then, selects the icon B203, the transparent image formation settings information are obtained by the CPU 101. This type of setup is convenient in a case where a specific area or areas of the sheet S can be selected so that the selected area or areas can be subjected to a process other than the one for changing the selected area in gloss level (for example, giving selected area specific color). That is, multiple choices of processes, such as gloss changing process, color changing process, and the like, can be selectively used to process the areas selected with the use of the image file. However, the above-described setup is not intended to limit the present invention in scope. That is, the present invention is compatible to such a setup that an operator can select the graphics such as the one shown in FIG. 6, and instruct the image forming apparatus 100 to output a print, a specific area or areas of the image formation area of the recording sheet S of which are different in gloss level from the rest, and then, can select the areas to be adjusted in gloss.

After the transparent image formation settings are selected, an operator can enter the transparent image formation settings by selecting the icon B203 named "OK". As the operator selects an icon B205, the image forming apparatus 100 shows FIG. 5 on the display 111. If the operator presses the start button (with which the control panel is provided) at this point in time, image forming apparatus 100 forms an image which reflects the transparent image formation settings.

Obviously, an operator can select an icon B206 (named "Cancel") in the graphics shown in FIG. 6 to make the image forming apparatus 100 discard the transparent image formation settings. As the operator selects the icon B206, the image forming apparatus 100 discards the transparent image formation settings selected with the use of the graphics shown in FIG. 6, and shows the graphics shown in FIG. 5, on the display 111.

3-3. Control Flow

Next, the flow of the operation of the image forming apparatus 100 in this embodiment in the transparent image formation mode is described.

Figure 7:
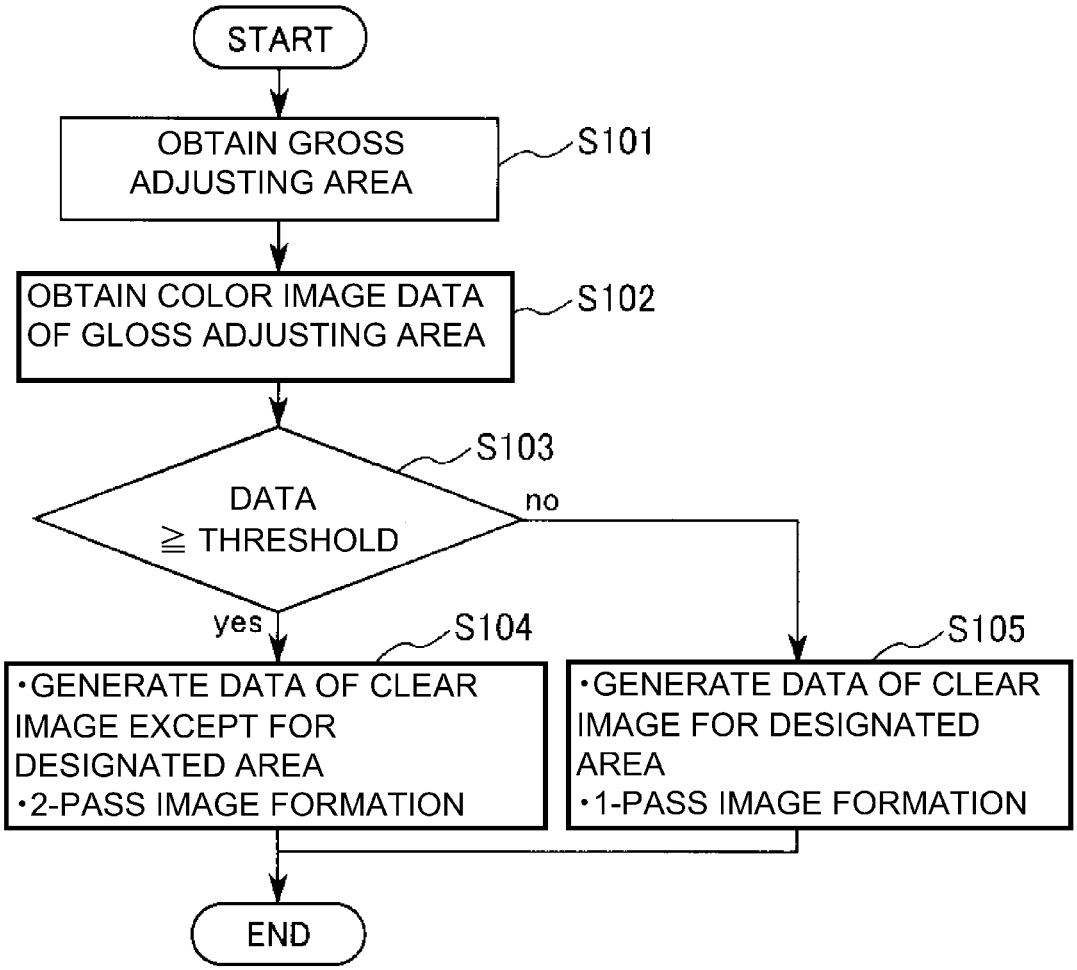
FIG. 7 is a flowchart of the image formation sequence of the image forming apparatus in the transparent image formation mode, in the first embodiment.

FIG. 7 is a flowchart which shows the flow of the operation of the image forming apparatus 100 in the transparent image formation mode in this embodiment. When the image forming apparatus 100 is in the transparent image formation mode, its CPU 101 controls the operation of the image forming apparatus 100 based on the program stored in the ROM 103, such as the one shown in FIG. 7.

Step S101 is the step for the CPU 101 to obtain the information about the transparent image formation settings set by an operator. In this step, the CPU 101 (as means for obtaining information about areas to be different in gloss level) obtains the information which specifies the areas to be adjusted in gloss. The information obtained by the CPU 101 is stored in the RAM 102.

Step S102 is the step for the CPU 101 to obtain the information about the amount of the color toner on the gloss adjustment areas. In this embodiment, the controller section 119 makes the image forming apparatus 100 carry out, as necessary, the processes for optimizing the inputted RGB signals, such as the masking process, UCR process, γ-correction process, etc., and converts the inputted RGB signals into the YMCK signals for outputting the RGB signals with the use of the printer section 115. In concrete terms, the information about the color toner amount on the gloss adjustment areas in this embodiment is the information about the image density of the color image to be formed within the gloss adjustment areas, which is obtained in Step S102. More specifically, the information about the color toner amount in the gloss adjustment area is the average value (area mean) of the values of the Y, M, C and K signals which correspond to the color image areas within the gloss adjustment area (integrated value of density level signals of four color images, different in color).

Step S103 is the step for the CPU 101 to determine, based on the information about the color toner amount on the gloss adjustment area obtained in Step S102, whether the single-pass image formation method or double-pass image formation method is to be used for image formation. Further, Step S103 is also the step for the CPU 101 to determine the areas (marked area or background area) to which the transparent toner is adhered. If the obtained color toner amount is no less than a threshold value, the CPU carries out the process in Step S104. On the other hand, if the obtained color toner amount is no more than the threshold value, the CPU 101 carries out the process in Step S105. In this embodiment, this threshold value was set to 100% based on the relationship between the color toner amount and gloss level shown in FIGS. 3 and 4.

The relationship between the color toner amount and gloss level, such as the one shown in FIG. 3, is affected by the type of the sheet S of recording medium on which an image is formed, ambient conditions, type of the toner used for image formation, process speed, etc. Therefore, it is assumed here that the relationship between the color toner amount and gloss level, which is used to control the image forming apparatus 100, is stored as LUT (lookup table) in the ROM 103 or HDD 104.

Step S104 is the step in which transparent image data is generated, and the double-pass image formation method is used for image formation. Here, the transparent image data is the data to be transmitted to the printer section 115 to form a transparent image on the sheet S of recording medium, in order to make the image forming apparatus 100 output a print, the gloss adjustment areas of the image formation area of the sheet S of which are different in gloss level from the other areas. In Step S104, the CPU 101 (as transparent image data generating means) generates such transparent image data that causes the image forming apparatus 100 to form a transparent toner image in such a pattern that the transparent toner of the transparent toner image covers the areas of the image formation area of the sheet S of recording medium, which are not the gloss adjustment areas (marked areas) of the image formation area. Referring to FIG. 4, in a case where an image which is no less than 100% (threshold value) in color toner amount is formed with the use of the double-pass image formation method, the areas of the sheet S, across which the transparent toner of the transparent toner image covers the color toner of the color image, become lower in gloss level than the areas covered with only the color toner of the color toner.

Step S105 is the step in which the transparent image data is formed and the single-pass image formation method is used for image formation. In Step S105, the CPU 101 (as transparent image data generating means) generates such transparent image data that makes the image forming station PK to form such a transparent toner image that the transparent toner of the transparent toner image covers the gloss adjustment areas (marked areas) of the image formation area of the sheet S of recording medium. Referring to FIG. 3, in a case an image, the color toner amount of which is no more than 100% (threshold value) is formed with the use of the single-pass method, the areas of the sheet S, across which the color toner of the color toner image was covered with the transparent toner of the transparent toner image become higher in gloss level than the areas covered with the color toner of the color image (color toner) alone.

It is through the operation of the image forming apparatus 100 in the transparent toner image formation mode described above that a print which has a desired amount of difference in gloss level between its gloss adjustment areas of the image formation area of the sheet S of recording medium, which were selected by an operator, and the rest, can be obtained.

3-4. Image Forming Operation in Transparent Image Formation Mode

Figure 8:
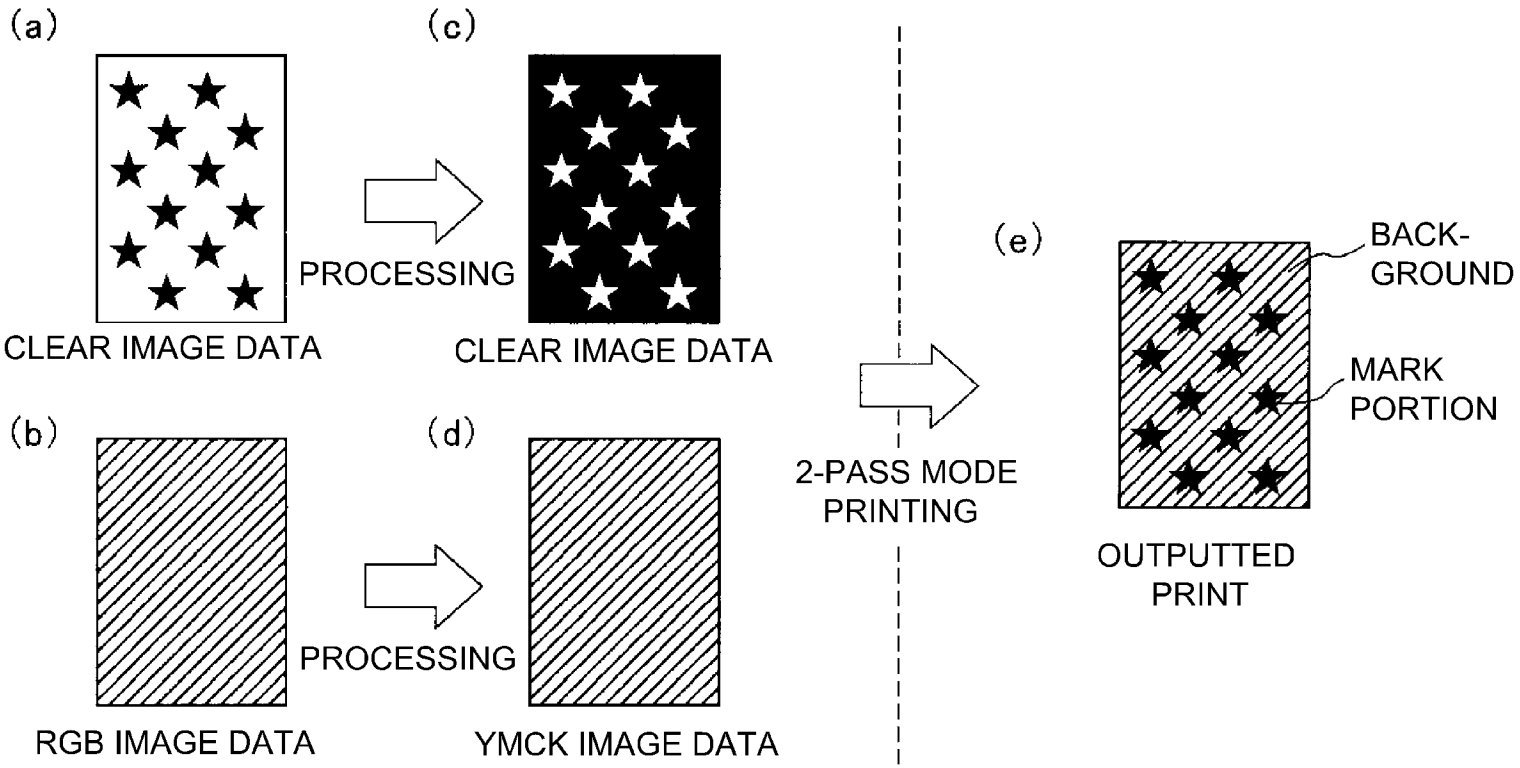
FIG. 8 is a schematic drawing for conceptually showing the image processing sequence for forming an image, in the transparent image formation mode.
Figure 9:
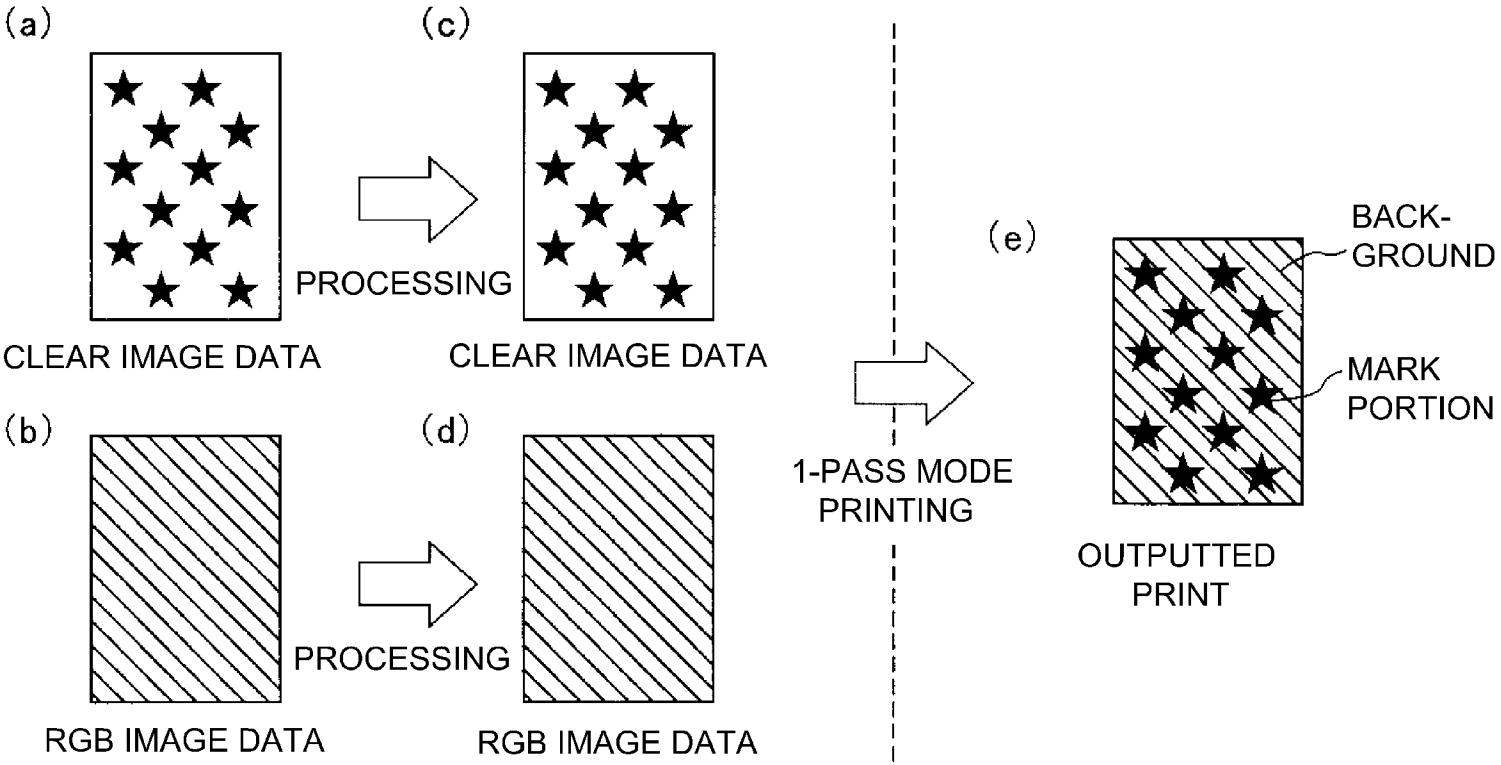
FIG. 9 is another schematic drawing for conceptually showing the image processing sequence for forming an image, in the transparent image formation mode.

FIGS. 8 and 9 are drawings for showing the image processing sequence in the transparent image formation mode.

FIG. 8 schematically shows the image formation sequence for forming an image with the use of the double-pass image formation method in the transparent image formation mode. First, the transparent image data (as data for selecting gloss adjustment areas) is inputted into the CPU 101 (FIG. 8(*a*)). Based on the inputted image data for the transparent toner image, the CPU 101 generates the transparent image data for forming a transparent image on the sheet S of recording medium (FIG. 8(*c*)). Further, the RGB data (as image information signals) are inputted into the CPU 101 (FIG. 8(*b*)). Then, the CPU 101 converts the inputted RGB data into the YMCK data as the color image data for forming color images on the sheet S (FIG. 8(*d*)). Here, the color image data is the data to be transmitted to the printer section 115 to form color images on the sheet S.

The operation shown in FIG. 8 is an example of the one which uses the 2-pass image formation method. Thus, when the CPU 101 generates the transparent image data, it detects whether or not the amount by which color toner is going to be adhered to the gloss level adjustment areas, and which was obtained based on the YMCK image data (as color image data), is no less than the threshold value. Then, the CPU 101 generates such transparent image data (negative of transparent image data) that makes the image formation station PT form such a transparent toner image that its transparent toner covers the other area (background area) of the sheet S of recording medium than the areas selected by the inputted transparent image data for determining the gloss level adjustment areas.

Then, the CPU 101 makes the printer section 115 carry out the double-pass image forming operation, based on the generated transparent image data and color image data. That is, a color toner image or color toner images are formed on the sheet S of recording medium, based on the YMCK image data. Then, the first fixation process is carried out. Then, a transparent toner image is formed on the fixed color toner image on the sheet S, based on the transparent toner image data. Then, the second fixation process is carried out. Lastly, a completed print is discharged from the image forming apparatus 100 (FIG. 8(*e*)).

FIG. 9 schematically shows the single-pass image formation operation carried out by the image forming apparatus 100 in the transparent image formation mode. First, the CPU 101 generates the transparent image data and color image data, and makes the image forming apparatus 100 form a transparent toner image and a color toner image, based on the generated transparent image data and color image data, respectively, on the sheet S of recording medium. Up to this point, this image forming operation is the same in flow as the double-pass image forming operation shown in FIG. 8 (FIGS. 9(*a*)-9(*d*)).

However, the image forming operation shown in FIG. 9 is of the single-pass image forming operation. Therefore, when the CPU 101 generates the transparent image data, it determines whether or not the amount by which color toner will be adhered to the gloss level adjustment area, and which is obtained from the YMCK image data (as color image data), is no more than the threshold value. Then, the CPU 101 generates such transparent image data (data of positive of transparent image) that makes the image forming apparatus 100 form such a transparent image that the transparent toner of the transparent image covers the areas of the sheet S designated by the inputted transparent toner image data which shows the gloss level adjustment area.

Further, the CPU 101 make the printer section 115 carry out the single-pass image forming operation, based on the generated transparent image data and color image data. That is, a color image is formed on the sheet S of recording medium based on the YMCK image data, and then, a transparent toner image is formed on the color toner image on the sheet S. Then, the first fixation process is carried out, and a finished print is discharged from the image forming apparatus 100 (FIG. 9(*e*)).

As described above, in this embodiment, the image forming apparatus 100 has the color image forming means which forms a color image on recording medium with the use of color toner. It has also the transparent image forming means which forms a transparent toner image in such a manner that the transparent toner of the transparent toner image covers a part or parts of the image formation area of the sheet S of recording medium, across which the color toner image has just been formed with the use of the color image forming means. The color image forming means comprises: the second to fifth image formation stations PY, PM, PC and PK; intermediary transfer unit 70; secondary transfer roller 90; etc. The transparent image forming means comprises: the first image formation station PT; intermediary transfer unit 70; secondary transfer roller 9; etc. The image forming apparatus 100 has the fixing device 10 as the fixing means for fixing an unfixed toner image formed on the sheet S of recording medium to the sheet S. The fixing device 10 fixes, and/or changes in gloss level, the toner image by heating the sheet S and the toner image thereon. The image forming apparatus 100 has also the CPU 101 as the controlling means which makes the image forming apparatus 100 selectively operate in the first or second mode which will be described next. The first mode is such a mode that makes the image forming apparatus 100 form, first, a color toner image on the sheet S of recording medium; form a transparent toner image on the sheet S without thermally fixing the unfixed color toner image with the use of its fixing means; thermally process the sheet P and the images thereon with the uses of the fixing means; and discharge a finished print (single-pass image forming operation). The second mode is such a mode that makes the image forming apparatus 100 form, first, a color toner image; thermally process the sheet S and the unfixed color toner image thereon with the use of its fixing means; form a transparent toner image on the sheet S; thermally process the sheet S and the fixed color toner image and unfixed transparent toner images thereon, with the use of the fixing means; and discharge a finished print (double-pass image forming method).

Further, the image forming apparatus 100 has the storage means (ROM, HDD, etc.) in which the information compared, by the controlling means, with the information about the toner amount of the color toner image formed on the sheet S of recording medium, to determine in which of the aforementioned first and second modes the image forming apparatus 100 is to be operated, is stored. In this embodiment, the information used by the controlling means to select one of the first and second modes is the information about the threshold value for the color toner amount, which is used for switching the image forming apparatus 100 in operational mode between the first and second modes. This information for the mode selection is such information that provides the controlling means with the following. That is, it shows, based on the information about the amount by which color toner is adhered to the sheet S of recording medium to form a color toner image, which of the first and second modes makes greater the difference in gloss level between an area of the sheet S, on which a transparent toner image preset in toner amount is layered on the color toner image on the sheet S, and an area of the sheet S, on which the transparent toner image is not layered on the color toner image on the sheet S, after fixation. In particular, in this embodiment, the controlling means compares the amount by which the color toner is going to be adhered to the area of the image formation area of the sheet S of recording medium which is going to be covered with the transparent toner of the transparent toner image, with the information for determining in which of the first and second mode the image forming apparatus 100 is to be operated.

3-5. Concrete Examples of Gloss Level

Next, a concrete example of the gloss level of the marked area of a print outputted in the transparent image formation mode and that of the gloss level of the background area are described. As described above, in this embodiment, the threshold value for the color toner amount in the gloss level adjustment area, which is for switching the image forming apparatus 100 in operation mode between the single-pass image forming operation and double-pass image forming operation is 100%.

In the first example of comparative image forming operation, when the single-pass image formation method is to be used, the double-pass image formation method was intentionally used in place of the single-pass method, whereas when double-pass image formation method is to be used, the single-pass method was intentionally used in place of the double-pass method. However, the first example of comparative image forming operation, however, made different from the first embodiment in terms of which of the marked area and background area is to be covered with the transparent toner of a transparent toner image, based on the relationship between the color toner amount and gloss level shown in FIGS. 3 and 4, so that after fixation, the marked area will be higher in gloss level than the background area.

Described first is a case in which a color image, the entirety of which is uniform in color toner amount at 160% is formed in the image formation area of the sheet S of recording medium, and the gloss adjustment area of the image formation area is made higher in gloss than the rest, by the formation of a transparent toner image which is 70% in the transparent toner amount, over the color toner image. In the first embodiment, based on the relationship between the color toner amount and gloss level shown in FIGS. 3 and 4, the negative version of the transparent image data, which is for covering the background area with the transparent toner of a transparent toner image was used to form a transparent toner image, using the double-pass image formation method. Table 1 is the summary of this embodiment and comparative example 1, regarding the toner amount of the marked area, toner amount of background area (image density signal (%), and toner amount per unit area (mg/cm$^2$) obtained by conversion), and gloss levels.

TABLE 1

| | | Embodiment 1 | | Comp. Ex. 1 | |
|---|---|---|---|---|---|
| | | Mark part | Back-ground | Mark part | Back-ground |
| Image density signal (%) | Non-transparent | 160 | 160 | 160 | 160 |
| | Transparent | 0 | 70 | 70 | 0 |
| Toner/unit area (mg/cm$^2$) | | 0.88 | 1.27 | 1.27 | 0.88 |
| Outputting type | | 2-pass | | 1-pass | |
| 60 deg. Glossiness (%) | | 52 | 27 | 33 | 28 |

As is evident from Table 1, in this embodiment, the amount of difference in gloss level between the marked area and background area is 25%, whereas it is only 5% in the case of the first comparative example. In other words, this embodiment is more effective to make the marked area different in gloss level from the background area, than the first comparative example.

Described next is a case in which a color image, the entirety of which is uniform in color toner amount at 75%, is formed, and the gloss adjustment area in the image formation area of the sheet S of recording medium was made higher in gloss than the rest, by forming a transparent toner image, which is 70% in the transparent toner amount, on the color toner image. In this embodiment, based on the relationship between the color toner amount and gloss level shown in FIGS. 3 and 4, the positive version of the transparent image data, which is for covering the marked area with the transparent toner of a transparent toner image, was used in combination with the single-pass image formation method. Table 2 is the summary of this embodiment and second comparative example, regarding the amount of toner of the marked area and the amount of toner of the background area (image density signal (%) and toner amount per unit area (mg/cm$^2$) obtained by conversion).

TABLE 2

| | | Embodiment 1 | | Comp Ex. 2 | |
|---|---|---|---|---|---|
| | | Mark part | Back-ground | Mark part | Back-ground |
| Image density signal (%) | Non-transparent | 75 | 75 | 75 | 75 |
| | Transparent | 70 | 0 | 0 | 70 |
| Toner/unit area (mg/cm$^2$) | | 0.8 | 0.41 | 1 | 0.8 |
| Outputting type | | 1-pass | | 2-pass | |
| 60 deg. Glossiness (%) | | 35 | 25 | 36 | 32 |

As is evident from Table 2, in the case of this embodiment, the amount of difference in gloss level between the marked area and background area is 10%, whereas in the case of the second comparative example, it is only 4%. In other words, this embodiment is more effective to make the marked area different in gloss level from the background area than the second comparative example.

As described above, in this embodiment, the transparent image data was generated based on the color toner amount in the gloss adjustment area selected by an operator, and then, the single-pass image formation mode or double-pass image formation mode is selected. Therefore, it was possible to obtain a print, the gloss adjustment area of the image formation area of the sheet S of which selected by an operator is different in gloss level by a preset amount from the rest.

[Embodiment 2]

Next, another embodiment of the present invention is described. The basic structure and operation of the image forming apparatus in this embodiment are the same as those of the image forming apparatus in the first embodiment. Therefore, the portions of the image forming apparatus in this embodiment, the function and structure of which are the same as, or equivalent to, the counterparts of the image forming apparatus in the first embodiment, are given the same referential codes as those given to the counterparts in the first embodiment, and are not going to be described in detail.

In the first embodiment, matte coated paper ("U-light (registered commercial name: product of Nippon Paper Industries Co., Ltd.), which is 157 g/cm$^2$ in basis weight) was used as the recording medium. Generally, as a certain amount (for example, 70% which is amount of transparent toner used in transparent toner formation mode) of transparent toner is fixed to the sheet S of the so-called low gloss paper (matte paper), the sheet S is likely to become higher in gloss. How much the sheet S increases in gloss is affected by the fixation condition, and toner type. Referring to the curved broken line in FIG. 3, when the color toner amount is 0%, the sheet S of matte coated paper is 6% in gloss after the first fixation. That is, the sheet S of plain matte coated paper is 6% in gloss level after the first fixation. Next, referring to curved single-dot chain line in FIG. 3, when the color toner amount was 0%, the gloss level of a given point of the image formation area of the sheet S of recording medium, which was covered with the transparent toner of a transparent toner image, was equal to the gloss level of the area of sheet S covered with the transparent toner of a transparent toner image which was 70% in toner amount. As is evident from FIG. 3, the area of the aforementioned matte coat paper, to which the transparent toner of the transparent toner image was adhered, increased in gloss compared to the gloss level (6%) of the sheet S itself. Therefore, it is classified as low gloss paper.

However, the relationship between the color toner amount and gloss level when high gloss paper is used as recording medium is different from that when low gloss paper is used as recording medium. Therefore, the color toner amount threshold value for switching the image forming apparatus 100 in image formation method between the single-pass method and double-pass method in this embodiment is different from the one in the first embodiment.

In this embodiment, high gloss paper was used as recording medium (sheet S). More specifically, in this embodiment coated high gloss paper ("SA kanafuji+ (registered commercial name: product of Oji Paper Co., Ltd.) which is 157 g/m$^2$ in basis weight was used as recording medium (sheet S). Generally, the so-called high gloss paper has such a tendency that as a certain amount (for example, 70% which is equivalent to amount by which transparent toner is adhered to sheet S in transparent image formation mode) is fixed to it, it does not significantly change in gloss level, or reduce in gloss level. This tendency is affected by the fixation condition and toner type. As will be described later in more detail, referring to the curved broken line in FIG. 10 which is similar in contents to FIG. 3 except for the recording medium (sheet S) type, when the color toner amount is 0%, the gloss level is the same as the gloss level (50%) of the gloss coated paper itself after the first fixation process. Referring to the curved broken line in FIG. 10, when the color toner amount is 0%, the gloss level is the same as the gloss level after the a transparent toner image, which is 70% in toner amount, is formed on a sheet of gloss coated paper used in this embodiment and is put through the first fixation process. As is evident from FIG. 10, in the case of the gloss coated paper used in this embodiment, its area to which the transparent toner of a transparent toner image which was 70% in toner amount was fixed was lower in gloss level than its original gloss, and therefore, is classified as high gloss paper.

The various factors (toner type, toner amount, process speed, nip pressure, etc.), excluding recording medium type, which are thought to affect the level at which the gloss of the surface of the sheet S will be after fixation in this embodiment are the same as those listed in the description of the first embodiment.

1. Relationship Between Toner Amount (Per Unit Area) and Gloss Level

Next, the relationship between the color toner amount (per unit area) and the gloss level when the gloss coated paper is used as recording medium is described.

(Single-pass Image Formation Method)

Figure 10:
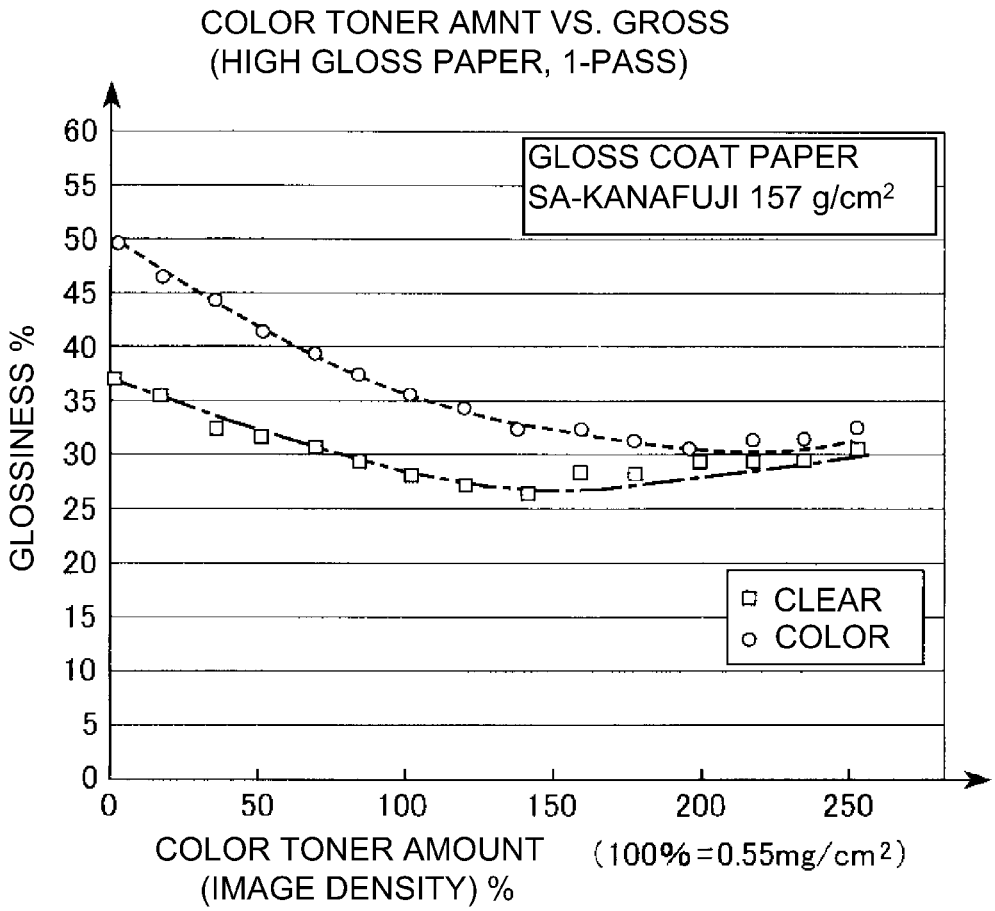
FIG. 10 is a graph which shows the relationship between the color toner amount (per unit area) on a given area of a sheet of recording medium, and the gloss level of the given area after fixation, when a print is produced with the use of the single-pass image formation method, and a sheet of high gloss paper, in the transparent image formation mode.

FIG. 10 is a graph which shows the relationship between the amount by which color toner is fixed to a given area of the surface of the sheet S of recording medium with the use of the single-pass image formation method, and the gloss level of the given area of the surface of the sheet S after the fixation of the toner. The vertical axis of the graph stands for the gloss level, and the horizontal axis stands for the amount of the color toner fixed to the sheet S.

The curved broken line in FIG. 10 shows the relationship between the amount of the toner fixed to a given area of the sheet S of recording medium, and the gloss level of the given area after the first fixation process in a case where it is only color toner that was fixed to the given area of the sheet S. The curved single-dot chain line in FIG. 10 shows the relationship between the amount of toner fixed to a given area of the sheet S and the gloss level of the given area after the first fixation process in a case where a color toner image, and a transparent toner image which is 70% in toner amount, are formed on the sheet S.

As is evident from FIG. 10, in the range where the color toner amount is no less than 70%, in particular, no less than 150%, there is no significant difference in gloss level between a case in which only a color toner image was formed and a case in which a combination of a color toner image, and a transparent toner image which is 70% in toner amount, was formed. That is, it is evident that in the area of FIG. 10 in which the color toner amount is no less than 70%, in particular, no less than 150%, it is difficult to output a print, the selected area of the image formation area of the sheet S of recording medium of which is significantly different in gloss level from the rest, with the use of the single-pass image formation method.

(Double-pass Image Formation Method)

Figure 11:
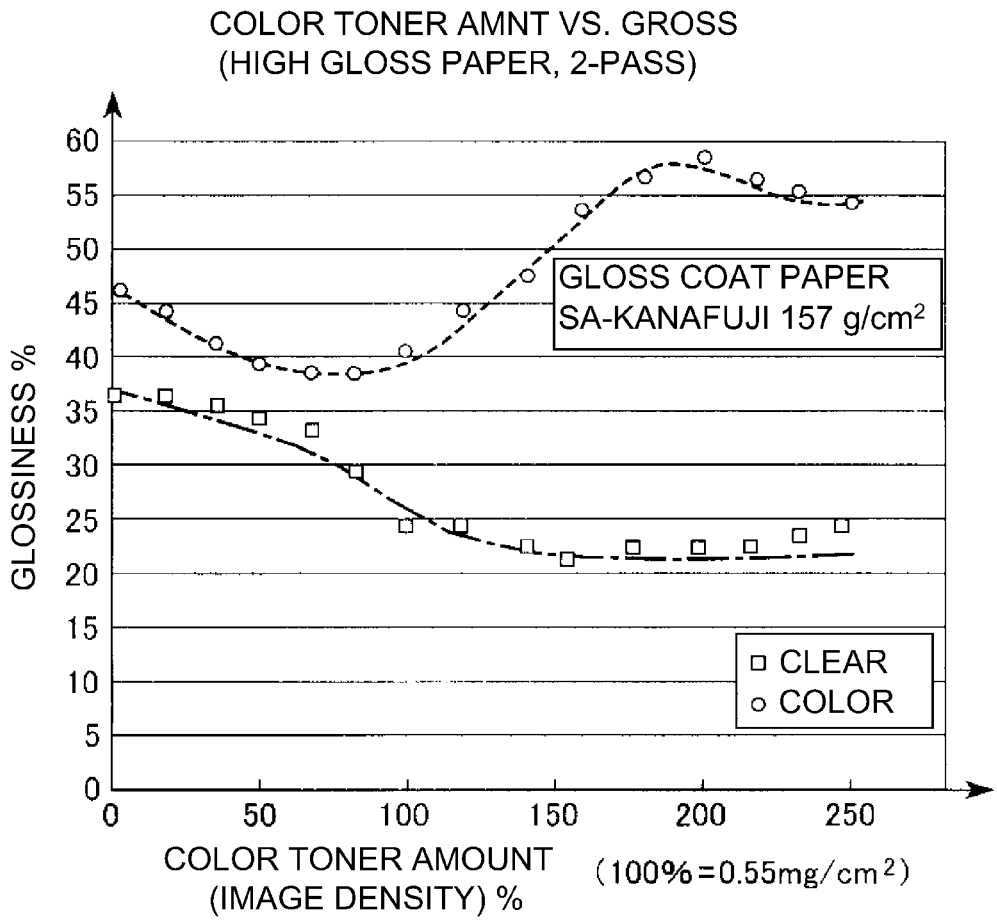
FIG. 11 is a graph which shows the relationship between the color toner amount (per unit area) on a given area of a sheet of recording medium, and the gloss level of the given area after fixation, when a print is produced with the use of the double-pass image formation method, and a sheet of high gloss paper, in the transparent image formation mode.

FIG. 11 is a graph which shows the relationship between the amount by which color toner is fixed to a given area of the surface of the sheet S of recording medium per unit area of the sheet S, and the gloss level of the given area after the fixation of the toner (color toner), when the double-pass image formation method was used. The vertical axis of the graph stands for the gloss level, and the horizontal axis of the graph stands for the amount by which color toner is adhered to the sheet S per unit area of the sheet S.

The curved broken line in FIG. 11 shows the relationship between the amount by which color toner was adhered to a given area of the sheet S of recording medium to form only a color toner image on the sheet S, and the gloss level of the given area after the first and second fixation processes. The curved single-dot chain line in FIG. 11 shows the amount by a combination of color toner and transparent toner is adhered to a given area of the sheet S, and the gloss level of the given area after the first and second fixation process in a case where a color toner image was first formed on the sheet S and was fixed (first fixation process) to the sheet S; and a transparent image which was 70% in toner amount was formed in such a manner as to cover the fixed color toner image, and was fixed (second fixation process).

Paying attention to the relationship, shown by the broken line and single-dot chain line in FIG. 11, between the amount by which toner was adhered to a given area of the sheet S of recording medium, and the gloss level of the given area after the fixation when the color toner amount was 150%, an area of the sheet S of recording medium, which was covered with the color toner of the color image, but was not covered with the transparent toner of the transparent toner image was 47% in gloss level, because it was subjected to two fixation processes. On the other hand, an area of the sheet S, which was not covered with the color toner of the color image, but was covered with the transparent toner of the transparent toner image which was 70% in toner amount was 22% in gloss level, because the transparent toner was subjected to the fixation process only once.

The curved broken line in FIG. 11 shows the relationship between the amount of the color toner on a given area of the sheet S of recording medium and the gloss level of the given area after the sheet S was subjected to the fixation process twice when the double-pass image formation method was used. Referring to the curved broken line in FIG. 11, when the color toner amount was 0%, an area of the sheet S of recording medium, on which neither a color toner image nor a transparent image was formed, that is, an area of the sheet S covered with neither color toner nor transparent toner, was the same as the gloss level (47%) of the sheet S itself after the second fixation process. As for the curved single-dot chain line in FIG. 11, it shows the relationship between a given area of the sheet S, which was covered with the transparent toner of the transparent toner image which was 70% in toner amount, and the gloss level of the given area after the second fixation, when the double-pass image formation method was used. That is, the single-dot chain line shows the gloss level of a given area of the sheet S after the sheet S was subjected to the first fixation process without forming a color image on the sheet S; a transparent toner image which was 70% in toner amount was formed on the sheet S; and the sheet S was put through the second fixation process.

On an area of the sheet S of recording medium (broken line in FIG. 11), on which a transparent toner image was not formed in such a manner as to cover the color toner image on the area with transparent toner, the surface of the color toner image was subjected to heat twice with the fixing device 10. In comparison, on an area of the sheet S (single-dot chain line in FIG. 11), on which a transparent toner image was formed in such a manner as to cover the color toner image on the area, with transparent toner, the transparent toner layer, that is, the surface toner layer, was subjected to heat only once, being therefore unlikely to be higher in gloss after the fixation.

Referring to FIG. 11, in the range in which the color toner amount is no more than 70%, more specifically, in a range of 30%-70%, whether only a color toner image, or a combination of a color toner image, and a transparent toner image which is 70% in toner amount, is formed on a give area of the sheet S of recording medium, that is, whether a given area of the sheet S is covered with only color toner (no more than 70%), or a combination of color toner and transparent toner (70%), does not significantly affect the given area in resultant gloss level. That is, when the color toner amount is no more than 70, in particular, when it is in a range of 30-70%, it is difficult to make the image forming apparatus 100 to output a print, the selected area or areas of the image formation area of the sheet S of recording medium of which are different in gloss level from the rest, with the use of the double-pass image formation method.

As described above, there is a color toner amount range, in which it is difficult to obtain a print, the selected area or areas of which are different in gloss level from the rest, regardless of whether the single-pass image formation method or the double-pass image formation method is used. For example, under the image formation condition in this embodiment, as long as the color toner amount is no more than 70%, the single-pass image formation method is superior to the double-pass image formation method in terms of the formation of a print, the selected area or areas of which are different in gloss level from the rest, whereas in a case where the color toner amount is no less than 70%, the double-pass image formation method is superior to the single-pass image formation method.

2. Concrete Example

Next, a concrete example of the relationship in gloss level between the marked area and background area of a print outputted in the transparent toner image formation mode is described.

The image forming operation carried out by the image forming apparatus 100 in this embodiment in the transparent toner image formation mode is the same as that of the image forming apparatus 100 in the first embodiment, which was described with reference to FIGS. 7, 8 and 9. This embodiment, however, is different from the first embodiment in that the recording medium used in this embodiment is gloss coated paper, which is different from the one used in the first embodiment. Further, this embodiment is different from the first embodiment in that the threshold value used in this embodiment for switching the image forming apparatus in image formation method between the single-pass image formation method and double-pass image formation method, based on the relationship between the color toner amount and gloss level, which is shown in FIGS. 10 and 11, is 70%. Moreover, this embodiment is different from the first one in that in a case where the single-pass image formation method is used, the negative version of the transparent image data for forming a transparent image is used in such manner as to cover the background.

In the comparative example, the double-pass image formation method was used when the single-pass image formation method should have been used, and the single-pass image formation method was used when the double-pass image formation method should have been used.

Described first is a case in which a color image which is uniform in color toner amount at 140% is formed on the image formation area of the sheet S of recording medium, and the gloss adjustment area of the image formation area of the sheet S is made higher in gloss level than the rest. In this case, according to this embodiment, based on the relationship between the color toner amount and gloss level, which is shown in FIGS. 10 and 11, an image is formed with the use of the double-pass image formation method in combination with the negative transparent image data for forming a transparent toner image in such a pattern that the background area of the color image is covered with transparent toner. Table 3 is a summary of this embodiment and third comparative example, about the relationship among the toner amount of the marked area, toner amount of the background area (image density signal (%), and toner amount per unit area ($mg/cm^2$) obtained by conversion), and resultant gloss levels.

TABLE 3

| | | Embodiment 2 | | Comp. Ex. 3 | |
|---|---|---|---|---|---|
| | | Mark part | Back-ground | Mark part | Back-ground |
| Image density signal (%) | Non-transparent | 140 | 140 | 140 | 140 |
| | Transparent | 0 | 70 | 0 | 70 |
| Toner/unit area ($mg/cm^2$) | | 0.77 | 1.16 | 0.77 | 1.16 |
| Outputting type | | 2-pass | | 1-pass | |
| 60 deg. Glossiness (%) | | 47 | 23 | 33 | 27 |

As is evident from Table 3, the amount of difference in gloss level between the marked area and background area was 24% in this embodiment, but it was only 6% in the third comparative example. In other words, this embodiment is superior to the third comparative example in that this embodiment makes it possible to yield a print, the marked area of which is more different in gloss level between its marked area and background area than a print which can be yielded by the third comparative example.

Described next is a case in which a color image which is uniform in the amount of color toner at 50% is formed on the image formation area of the sheet S of recording medium, and the gloss adjustment area of the image formation area of the sheet S was made higher in gloss level than the rest by forming a transparent image which is 70% in toner amount, on the image formation area of the sheet S. In this case, according to this embodiment, based on the relationship between the color toner amount and gloss level, which is shown in FIGS. 10 and 11, an image was formed with the use of the single-pass image forming method in combination with the negative version of the transparent image data for forming a transparent toner image in such a pattern that the background area of the color toner image was covered with transparent toner. Table 4 is a summary of this embodiment and fourth comparative example, about the relationship among the toner amount of the marked area, toner amount of the background area (image density signal (%), and toner amount per unit area ($mg/cm^2$) obtained by conversion), and resultant gloss levels.

TABLE 4

| | | Embodiment 2 | | Comp. Ex. 4 | |
|---|---|---|---|---|---|
| | | Mark part | Back-ground | Mark part | Back-ground |
| Image density signal (%) | Non-transparent | 50 | 50 | 50 | 50 |
| | Transparent | 0 | 70 | 0 | 70 |
| Toner/unit area ($mg/cm^2$) | | 0.28 | 0.66 | 0.28 | 0.66 |
| Outputting type | | 1-pass | | 2-pass | |
| 60 deg. Glossiness (%) | | 43 | 33 | 40 | 34 |

As is evident from Table 4, in this embodiment, the amount of difference in gloss level between the marked area and background area was 10%, whereas in the fourth comparative embodiment, it is only 6%. In other words, this embodiment makes it possible to obtain a print, the amount of difference in gloss level of which between its marked area and rest is significantly greater than that of a print obtained in the fourth comparative example.

As described above, according to this embodiment, even in case where high gloss paper is used as recording medium (sheet S), it was possible to obtain a print, the gloss adjustment area of the image formation area of the sheet S which selected by an operator is significantly different in gloss level from the rest.

[Embodiment 3]

Next, another embodiment of the present invention is described. The basic structure and operation of the image forming apparatus in this embodiment are the same as those of the image forming apparatus in the first embodiment. Therefore, the portions of the image forming apparatus in this embodiment, the function and structure of which are the same as, or equivalent to, the counterparts of the image forming apparatus in the first embodiment, are given the same referential codes as those given to the counterparts in the first embodiment, and are not going to be described in detail.

Figure 12:
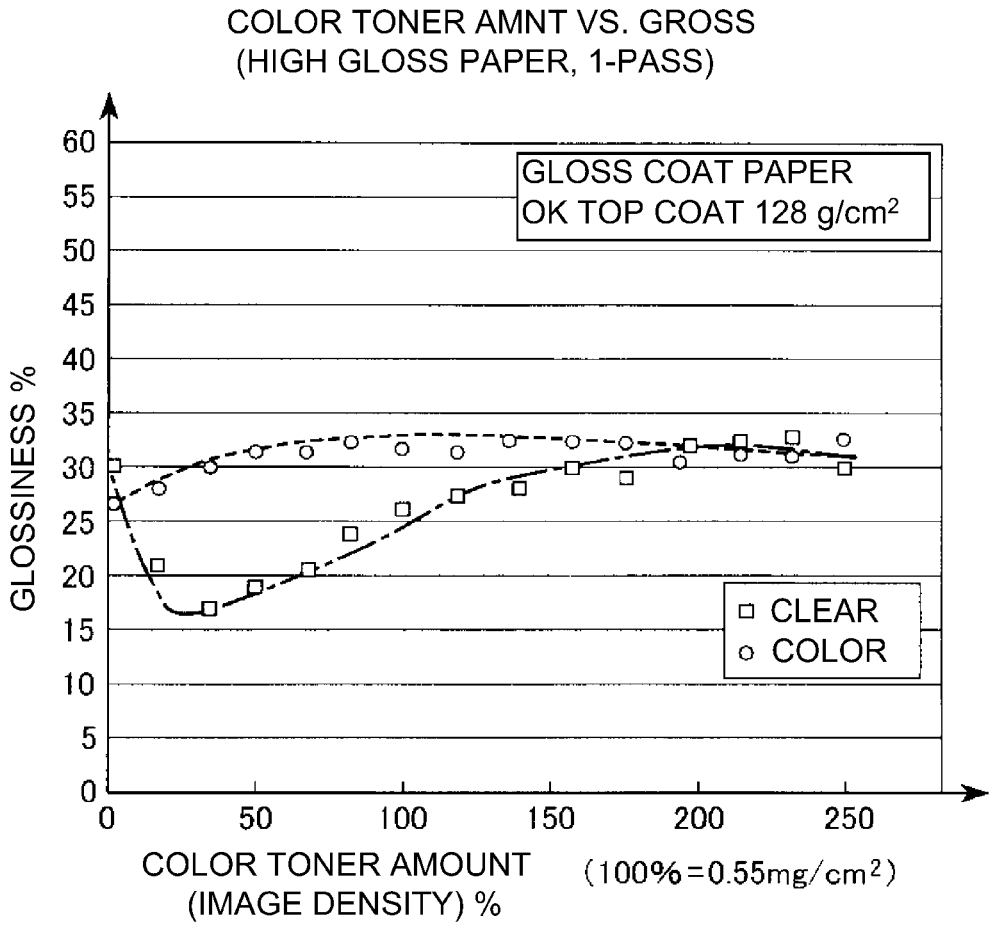
FIG. 12 is a graph which shows the relationship between the color toner amount (per unit area) on a given area of a sheet of recording medium, and the gloss level of the given area after fixation, when a print is produced with the use of the single-pass image formation method, and a sheet of high gloss paper which is different in type from the one used to obtain the graph in FIG. 11, in the transparent image formation mode.

In this embodiment, high gloss paper which is different from the one used in the second embodiment is used as recording medium (sheet S). More specifically, in this embodiment, glossy coat paper ("OK top coat+" (product of Oji Paper Co., Ltd.) which was 128 $g/m^2$ in basis weight was used as recording medium. Referring to the curved broken line in FIG. 12 which is the same in contents as FIG. 3 except for the recording medium type, in a case where the color toner amount was 0%, the gloss level of the sheet S of recording medium after the first fixation process is the same as the gloss level (27%) of the gloss coat paper itself after the first fixation process. Next, referring to the curved single-dot line in FIG. 12, in a case where the color toner amount is 0%, the gloss level after the fixation is the same as the gloss level of sheet S of gloss coated paper used in this embodiment after a transparent toner image which was 70% in toner amount was formed on the sheet S and the sheet S was subjected to the first fixation process. Referring to FIG. 12, in the case of the gloss coated paper used in this embodiment, its area to which the transparent toner of the transparent toner image which is 70% in toner amount was fixed was slightly higher in gloss level than the other area of the sheet S. However, the amount of difference in gloss level was not significant. Thus, the gloss coated paper used in this embodiment is classified as high gloss paper. Incidentally, if the amount by which transparent toner is fixed to the gloss coated paper used in this embodiment is smaller than the amount by which transparent toner was fixed to the sheet S in this embodiment, the area of the sheet S to which transparent toner was fixed will be less in gloss as was the gloss coated paper used in the second embodiment.

The various factors (toner type, toner amount, process speed, nip pressure, etc.), excluding recording medium type, which are thought to affect the level at which the gloss of surface of the sheet S will be after fixation in this embodiment are the same as those listed in the description of the first embodiment.

1. Relationship Between Toner Amount Per Unit Area and Gloss Level.

Next, the relationship between the color toner amount (per unit area) and the gloss level when the gloss coated paper is used as recording medium is described.

(Single-pass Image Formation Method)

FIG. 12 is a graph which shows the relationship between the amount by which color toner is fixed to a given area of the surface of the sheet S of recording medium with the use of the single-pass image formation method, and the gloss level of the given area of the surface of the sheet S after the fixation of the toner. The vertical axis of the graph stands for the gloss level, and the horizontal axis stands for the amount of the color toner fixed to the sheet S.

The curved broken line in FIG. 12 shows the relationship between the amount of the toner fixed to a given area of the sheet S of recording medium, and the gloss level of the given area after the first fixation process in a case where it is only color toner that was fixed to the given area of the sheet S. The curved single-dot chain line in FIG. 12 shows the relationship between the amount of toner fixed to a given area of the sheet S and the gloss level of the given area after the first fixation process in a case where a color toner image, and a transparent toner image which is 70% in toner amount, were formed on the sheet S.

As is evident from FIG. 12, in a color toner amount range where the color toner amount is no less than 100%, in particular, no less than 150%, there is no significant difference in gloss level between a case in which only a color toner image is formed and a case in which a combination of a color toner image, and a transparent toner image which is 70% in toner amount, was formed. That is, it is evident that in the color toner amount range of FIG. 12 in which the color toner amount is no less than 100%, in particular, no less than 150%, it is difficult to output a print, the selected area of the image formation area of the sheet S of recording medium of which is significantly different in gloss level from the rest, with the use of the single-pass image formation method.

(Double-pass Image Formation Method)

Figure 13:
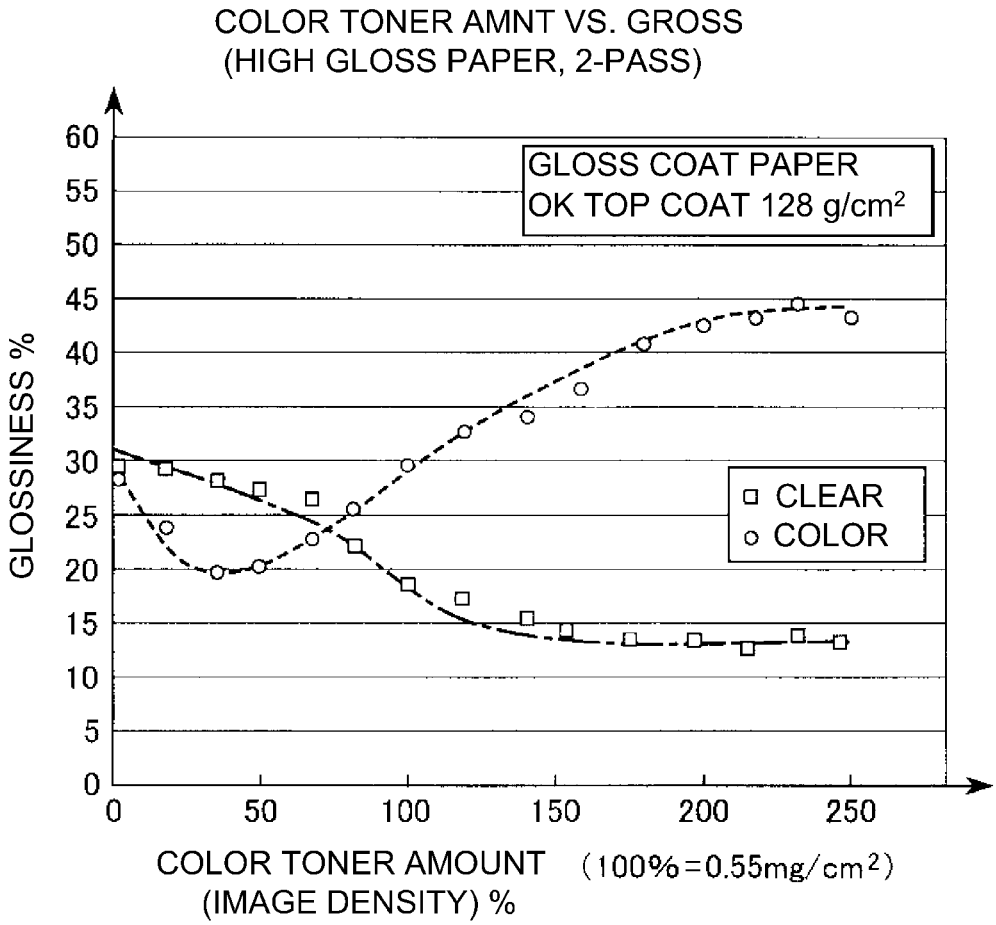
FIG. 13 is a graph which shows the relationship between the color toner amount (per unit area) on a given area of a sheet of recording medium, and the gloss level of the given area after fixation, when a print is produced with the use of the double-pass image formation method, and a sheet of high gloss paper which is different in type from the one used to obtain the graph in FIG. 11, in the transparent image formation mode.

FIG. 13 is a graph which shows the relationship between the amount by which color toner is fixed to a given area of the surface of the sheet S of recording medium per unit area of the sheet S, and the gloss level of the give area after the fixation of the toner (color toner), when the double-pass image formation was used. The vertical axis of the graph stands for the gloss level, and the horizontal axis of the graph stands for the amount by which color toner was adhered to the sheet S per unit area of the sheet S.

The curved broken line in FIG. 13 shows the relationship between the amount by which color toner was adhered to a given area of the sheet S of recording medium to form only a color toner image on the sheet S, and the gloss level of the given area after the first and second fixation processes when the double-pass image formation method was used. The curved single-dot chain line in FIG. 13 shows the amount by which a combination of color toner and transparent toner was adhered to a given area of the sheet S, and the gloss level of the given area after the first and second fixation process when the double-pass image formation method was used, that is, when a color toner image is first formed on the sheet S and is fixed (first fixation process) to the sheet S; and a transparent image which is 70% in toner amount was formed in such a manner as to cover the fixed color toner image, and was fixed (second fixation process).

Paying attention to the relationship, shown by the broken line and single-dot chain line in FIG. 13, between the amount by which toner was adhered to a given area of the sheet S of recording medium, and the gloss level of the given area after the fixation when the color toner amount was 150%, a portion of the color image, which was not covered with the transparent toner of the transparent toner image, was 37% in gloss, because it was subjected to two fixation processes. On the other hand, the area of the sheet S, which was covered with the color toner of the color image, but was not covered with the transparent toner of the transparent toner image was 70% in toner amount, was 15%, because the transparent toner was put through the fixation process only once.

The curved broken line in FIG. 13 shows the relationship between the color toner amount and gloss level when the double-pass image formation method was used. Referring to FIG. 13, when the color toner amount was 0%, an area of the sheet S of recording medium, on which neither a color toner image nor a transparent image was formed, that is, an area of the sheet S covered with neither color toner nor transparent toner, was the same in gloss level as the gloss level (30%) of the sheet S itself after the second fixation process. On the other hand, the curved single-dot chain line in FIG. 13 shows the relationship between a given area of the sheet S, which was covered with the transparent toner of the transparent toner image which was preset (70%) in toner amount, and the gloss level of the given area after the second fixation when the double-pass image formation method was used. Referring to the single-dot chain line in FIG. 13, when the color toner amount is 0%, that is, when a color toner image was not formed, the gloss level of a given area of the sheet S which was not covered with the color toner of the color toner image is the gloss level of the area of the sheet S, after the sheet S was put through the first fixation process; a transparent toner image which was 70% in toner amount was formed on the sheet S; and the sheet S was put through the second fixation process.

On an area of the sheet S of recording medium (broken line in FIG. 12), on which a transparent toner image was not formed in such a manner as to cover the color toner image on the area, with transparent toner, the surface of the color toner image was subjected to heat twice with the fixing device 10. However, on an area of the sheet S (single-dot chain line in FIG. 12), on which a transparent toner image was formed in such a manner as to cover the color toner image on the area, with transparent toner, the transparent toner layer, that is, the surface toner layer, is subjected to heat only once, being therefore unlikely to be higher in gloss after the fixation.

Referring to FIG. 13, in the color toner amount range in which the color toner amount is no more than 90%, more specifically, in a range of 60%-90%, whether only a color toner image is formed on the sheet S of recording medium, or a combination of a color toner image, and a transparent toner image which was 70% in toner amount, is formed on the sheet S, that is, whether a given area of the sheet S is covered with only color toner (no more than 90% in toner amount), or a combination of color toner and transparent toner (70% in toner amount), the given area is not significantly different in gloss level.

As described above, there is a color toner amount range, in which it is difficult to obtain a print, the selected areas of which are different in gloss level from the rest, regardless of whether the single-pass image formation method or the double-pass image formation method is used. For example, under the image formation condition in this embodiment, as long as the color toner amount is no more than 90%, the single-pass image formation method is superior to the double-pass image formation method in terms of the formation of a print, the selected areas of which are different in gloss level from the rest, whereas in a case where the color toner amount is no less than 90%, the double-pass image formation method is superior to the single-pass image formation method.

2. Concrete Example

Next, a concrete example of the relationship in gloss level between the marked area and background area of a print outputted in the transparent toner image formation mode is described.

The image forming operation carried out by the image forming apparatus 100 in this embodiment in the transparent image formation mode is the same as that of the image forming apparatus 100 in the first embodiment, which was described with reference to FIGS. 7, 8 and 9. This embodiment, however, is different from the first embodiment in that the recording medium used in this embodiment is gloss coat paper, which is different from the one used in the first embodiment. Further, this embodiment is different from the first embodiment in that the threshold value used in this embodiment for switching the image forming apparatus 100 in image formation method between the single-pass image formation method and double-pass image formation method, based on the relationship between the color toner amount and gloss level, which is shown in FIGS. 12 and 13, is 90%. Moreover, this embodiment is different from the first one in that in a case where the single-pass image formation method is used, the negative version of the transparent image data for forming a transparent image is used in such manner as to cover the background of the color image with the transparent toner.

In the comparative example, the double-pass image formation method was used when the single-pass image formation method should have been used, and the single-pass image formation method was used when the double-pass image formation method should have been used. However, the comparative embodiment is made different from this embodiment in terms of where on the marked area and background area of a color image, a transparent toner image is formed to yield a print, the marked area of which is higher in gloss level than the rest, based on the relationship between the color toner amount and gloss level, which is shown in FIGS. 12 and 13.

Described first is a case in which a color image which is uniform in color toner amount at 140% is formed on the image formation area of the sheet S of recording medium, and the gloss adjustment area of the image formation area of the sheet S was made higher in gloss than the rest, by the formation of a transparent toner image, which is 70% in toner amount, on the color toner image. In this case, according to this embodiment, based on the relationship between the color toner amount and gloss level, which is shown in FIGS. 12 and 13, an image is formed with the use of the double-pass image formation method in combination with the negative version of the transparent image data for forming a transparent toner image in such a pattern that the background area of the color image is covered with transparent toner. Table 5 is a summary of this embodiment and fifth comparative example, about the relationship among the toner amount of the marked area, toner amount of the background area (image density signal (%), and toner amount per unit area (mg/cm$^2$) obtained by conversion), and resultant gloss levels.

TABLE 5

| | | Embodiment 3 | | Comp. Ex. 5 | |
|---|---|---|---|---|---|
| | | Mark part | Back-ground | Mark part | Back-ground |
| Image density signal (%) | Non-transparent | 140 | 140 | 140 | 140 |
| | Transparent | 0 | 70 | 0 | 70 |
| Toner/unit area (mg/cm$^2$) | | 0.77 | 1.16 | 0.77 | 1.16 |
| Outputting type | | 2-pass | | 1-pass | |
| 60 deg. Glossiness (%) | | 35 | 15 | 33 | 28 |

As is evident from Table 5, the difference in gloss level between the marked area and background area was 20% in this embodiment, but it is only 5% in the fifth comparative example. In other words, this embodiment is superior to the fifth comparative example in that this embodiment makes it possible to yield a print, the marked area of which is more different in gloss level between its marked area and background area than a print which can be yielded by fifth comparative example.

Described next is a case in which a color image which is uniform in the amount of color toner at 50% was formed on the image formation area of the sheet S of recording medium, and the gloss adjustment area of the image formation area of the sheet S was made higher in gloss level than the rest by forming a transparent image which is 70% in toner amount, on the image formation area of the sheet S. In this case, according to this embodiment, based on the relationship between the color toner amount and gloss level, which is shown in FIGS. 12 and 13, an image was formed with the use of the single-pass image forming method in combination with the negative version of the transparent image data for forming a transparent toner image in such a pattern that the background area of the color toner image is covered with transparent toner. Table 6 is a summary of this embodiment and sixth comparative example, about the relationship among the toner amount of the marked area, toner amount of the background area (image density signal (%), and toner amount per unit area (mg/cm$^2$) obtained by conversion), and resultant gloss levels.

TABLE 6

| | | Embodiment 3 | | Comp. Ex. 6 | |
|---|---|---|---|---|---|
| | | Mark part | Back-ground | Mark part | Back-ground |
| Image density signal (%) | Non-transparent | 50 | 50 | 50 | 50 |
| | Transparent | 0 | 70 | 70 | 0 |
| Toner/unit area (mg/cm$^2$) | | 0.28 | 0.66 | 0.66 | 0.28 |
| Outputting type | | 1-pass | | 2-pass | |
| 60 deg. Glossiness (%) | | 32 | 18 | 26 | 20 |

As is evident from Table 6, in this embodiment, the amount of difference in gloss level between the marked area and background area was 14%, whereas in the sixth comparative embodiment, it is only 6%. In other words, this embodiment makes it possible to obtain a print, the amount of different in gloss level of which between its marked area and rest is significantly greater than that of a print obtainable by the sixth comparative example.

As described above, according to this embodiment, even in case where high gloss paper is used as recording medium (sheet S) as in the second embodiment, it is possible to obtain a print, the gloss adjustment area of which selected in the image formation area of the sheet S by an operator is significantly different in gloss level from the rest.

[Embodiment 4]

Next, another embodiment of the present invention is described. The basic structure and operation of the image forming apparatus in this embodiment are the same as those of the image forming apparatus in the first embodiment. Therefore, the portions of the image forming apparatus in this embodiment, the function and structure of which are the same as, or equivalent to, the counterparts of the image forming apparatus in the first embodiment, are given the same referential codes as those given to the counterparts in the first embodiment, and are not going to be described in detail.

First, the method for controlling the operation of the image forming apparatus according to recording medium type or the gloss level of recording medium in this embodiment is described.

1. Control Based on Recording Medium Type or Recording Medium Gloss Level

In the first embodiment, matte coat paper (U-light (registered trade name): product of Nippon Paper Industries Co., Ltd.) which is 157 g/m$^2$ in basis weight and 6% in gloss level was used as recording medium. In the second embodiment, coated glossy paper (SA kanafuji+ (registered commercial name): product of Oji Paper Co., Ltd.) which is 157 g/m$^2$ in basis weight and 50% in gloss level was used as recording medium. Further, in the third embodiment, gloss coat paper (OK topcoat+: product of Oji Paper Co., Ltd.) which is 30% in gloss level was used as recording medium.

Further, in the first to third embodiments, the image forming apparatus 100 was controlled so that it outputs a print, the gloss adjustment areas of the image formation area of the sheet S of recording medium of which selected by an operator are significantly different in gloss level from the rest, when the abovementioned three different papers were used as recording medium, respectively. Table 7 is a summary of the first to third embodiments, about the gloss level of each of the three different papers, and the threshold value for the color toner image, which is for switching the image forming apparatus in its image formation method between the single-pass image formation mode and single-pass image formation mode.

TABLE 7

| Recording material | Glossiness | Threshold |
|---|---|---|
| U-light Basis weight 157 g/cm$^2$ | 6 | 100 |
| SA Kanafuji + basis weight 157 g/cm$^2$ | 50 | 70 |
| OK top coat + basis weight 128 g/cm$^2$ | 30 | 90 |

As is evident from the description of the first to third embodiments, the relationship between the color toner amount and gloss level is affected by recording medium type. Therefore, the requirement (threshold value for color toner amount, which is for switching image forming apparatus in image formation method between single-pass image formation method and double-pass image formation method) for obtaining a print, the gloss adjustment areas of which are different in gloss level from the rest, is affected by recording medium type. Further, whether the negative version of the transparent image data or positive version of the transparent image data is to be used as the transparent image formation data when the single-pass image formation method, for example, is used is sometimes affected by recording medium type.

In the first to third embodiments, each of the three types of recording medium was differently dealt with from the others. However, it is desired that the image forming apparatus 100 is enabled to deal with various types of recording medium. In this embodiment, therefore, the image forming apparatus 100 was designed so that its image forming operation in the transparent toner image formation mode can be controlled by such a procedure that the information about the recording medium type is inputted by an operator.

For example, such information as the relationships among the recording medium type, color toner amount, and gloss level, which is shown in FIGS. 3, 4, 10, 11, 12 and 13, may be studied in advance, and be stored, as a LUT, in the ROM 103, HDD 104, or the like. However, it does not need to be the relationships themselves such as those shown in FIGS. 3, 4, 10, 11, 12 and 13 that are stored. For example, the information about the threshold values, information about which of the negative or positive version of the transparent toner image formation data is to be used in combination with each of the single-pass image formation method and double-pass image formation method, may be stored in relation to recording medium (sheet S) type, within the color toner amount ranges necessary for the image forming operations described in the first to third embodiments.

As long as recording medium type is selected by an operator or the like, and the information concerning the selected recording medium type is obtained by the CPU 101 of the image forming apparatus 100, the CPU 101 can control the image forming operation of the image forming apparatus 100 in the transparent toner image formation mode, using various information such as those prepared and stored in advance for each of various recording medium types.

As is evident from Table 7, there is a rough correlation between the gloss level of the sheet S of recording medium itself and the threshold value for the color toner image, which is for switching the image forming apparatus 100 in image forming method between the single-pass image formation method and double-pass image formation method. That is, the lower in gloss level the recording medium itself, the greater the threshold value. Therefore, it is preferable that the information which shows the relationship among recording medium type, color toner amount, and gloss level is obtained and stored in advance. However, it is also possible to control the image formation operation of the image forming apparatus 100 in the transparent toner image formation mode, based on the information about the gloss level of the recording medium (sheet S) itself.

In a case where the image forming operation of the image forming apparatus 100 in the transparent image formation mode is controlled based on the information about the gloss level of the sheet S of recording medium alone, it is possible to design the image forming apparatus 100 so that an operator can input the gloss level of the recording medium using a multi-step scale or continuous scale. Further, by storing in advance the information about the gloss level of each of various recording mediums (sheet S), and selecting recording medium type from this stored information, it is possible to select the corresponding gloss level, as will be described later in more detail. Instead, it is also possible to simply determine the relationship between each of the qualitative classifications, such as "low gloss paper", "high gloss paper", etc., and its gloss level, and store the relationship, so that as one of the classifications of the recording medium which is going to be used for image formation is selected, the corresponding gloss level is selected. Further, it is possible to set up the image forming apparatus 100 so that one of the numerical gloss levels can be directly selected, or one of the values which represent multiple gloss level ranges can be selected. In the case of the toner and fixation condition in this embodiment, the gloss level threshold value between the high gloss paper and low gloss paper is 20%. Therefore, the image forming apparatus 100 may be designed so that if the sheet S of recording medium is no less than 20% in gloss level, it is considered as a sheet of high gloss paper, and the control method in the second embodiment is used, whereas if the sheet S is no more than 20% in gloss level, it is considered as a sheet of low gloss paper, and the control used in the first embodiment is used. Hereafter, this embodiment is described in more detail with reference to one of the concrete examples.

2. Method for Obtaining Information Related to Type or Gloss Level of Recording Medium Next, an example of the method used by the image forming apparatus 100 to obtain the information related to the type or gloss level of recording medium is described.

FIG. 14 is an example of the graphics which prompts an operator to input the information related to the type or gloss level of the sheet S of recording medium. The operator can select a cassette 13*a*, a cassette 13*b*, or a manual feed tray 14, from the graphics on the display 11. The cassettes 13*a* and 13*b* contain the sheets S of recording medium which are to be used for printing. As the operator selects an icon B301 of the graphics in FIG. 14, a pull-down menus from which "cassette 1", "cassette 2" or "manual feed tray 14" can be selected appear on the display 111. The graphics which is to appear on the display 111 does not need to be limited to the pull-down menu. That is, it may be a menu other than the pull-down menu. For example, it may be a pop-up menu or the like. The operator is to select one of the icons, which is related to the recording medium feeding means (cassettes 13*a* and 13*b*, and tray 14) which is holding the sheets S of recording medium which are to be used for printing, from among the icons in the pull-down menu.

As the operator chooses "cassette 1", for example, as shown in FIG. 14, a list of the recording medium types which can be selected by the operator appear on the display 111. It is assumed here that the "cassette 1" contains sheets S of "gloss coat paper (product of Company A) which is 157 g/m$^2$ in basis weight", for example, and the "cassette 2" contains sheets S of matte coat paper (product of Company B) which is 157 g/m$^2$ in basis weight, for example. If the "cassette 1" icon is selected from the pull-down menu, the CPU 101 controls the image forming apparatus 100 so that the cursor B302 moves to the "gloss coat paper (product of Company A) which is 157 g/m$^2$ in basis weight". If the "cassette 2" icon is selected from the pull-down menu, the CPU 101 controls the image forming apparatus 100 so that the cursor B302 moves to the "matte coat paper (product of Company B) which is 157 g/m$^2$ in basis weight". Further, if the operator replaces the sheets S in the "cassette 1" with sheets S of the "gloss coat paper (product of Company A) which is 106 g/m$^2$ in basis weight", the operator is to carry out the following operation. First, the operator is to choose "cassette 1" by clicking on the icon B301, and then, to move the cursor B202 to "gloss coat paper (product of Company A) which is 157 g/m$^2$ in basis weight" in the recording medium type list on the display 111. This is how the operator can inform the image forming apparatus 100 of the type of the recording medium to be used for image formation.

The information, such as the one given in Table 8, about the relationship between each of the recording medium types and its gloss level, shown on the display 111, are stored in the ROM 103 HDD 104, or RAM 102 of the image forming apparatus 100. Therefore, as the "gloss coat paper (product of Company A) which is 157 g/m$^2$ in basis weight" is selected by the operator, the CPU 101 (as gloss level information obtaining means) can know that the gloss level of the recording medium to be used for image formation is 50%. Similarly, as the "matte coat paper (product of Company B) which is 157 g/m$^2$ in basis weight" is selected by the operator, the CPU 101 can know that the gloss level of the recording medium to be used for image formation is 6%.

TABLE 8

| Company | Recording material | Basis weight (g/m$^2$) | Glossiness (%) | Classification |
|---|---|---|---|---|
| A | Gloss-coat | 106 | 30 | High-gloss |
| A | Gloss-coat | 151 | 40 | High-gloss |
| A | Gloss-coat | 157 | 50 | High-gloss |
| A | Matt-coat | 106 | 10 | Low-gloss |
| B | Matt-coat | 156 | 9 | Low-gloss |
| B | Matt-coat | 157 | 6 | Low-gloss |

If the type of the sheets S of recording medium in the "cassette 1" is not in the list on the display 111, the operator can give the CPU 101 the information about the type of the sheets S in the "cassette 1" using the following method. That is, first, the operator is to select an icon B303 named "WEB" in the graphics in FIG. 14 so that the operator is allowed to access the recording medium information data base, for example, on the network. Then, the operator is to select the type of the sheets S of recording medium in the "cassette 1", from the data base. With the use of this method, the operator can input the type of the sheets S of recording medium in the "cassette 1", even if the list on the display 111 does not include the type of the sheets S in the "cassette 1".

Further, the image forming apparatus 100 is designed so that the operator can directly input the gloss level of the sheet S of recording medium in the "cassette1", "cassette 2" or "manual feed tray". For example, an icon B304 in the graphics in FIG. 14 is a slider bar having multiple gradations, which can be used by the operator to input the information about the gloss level of the sheet S of recording medium to be used for image formation. That is, the operator can choose the information about the gloss level of the sheet S of recording medium to be used for image formation, with the use of the slider bar of the icon B304 having multiple gradations (10 gradations in range of 0-100%).

However, the choice of the means to be used by an operator to input the gloss level of the sheet S of recording medium does not need to be limited to the slider bar. For example, the image forming apparatus 10 may be designed so that an icon named "high gloss paper" or the like, which is to be selected in a case where the sheets S placed in the selected cassette by the operator are high in gloss level, an icon named "low gloss paper" or the like, which is to be selected in a case where the sheets placed in the selected cassette by the operator are low in gloss level, and the like icons, are presented on the display 111, so that if the operator thinks that the sheets S in the selected cassette are high in gloss level, the operator can select the icon named "high gloss paper" on the display 111, whereas if the operator thinks that the sheets S in the selected cassette are low in gloss level, the operator can select the icon named "low gloss level". Further, the image forming apparatus 100 may be designed so that the operator can directly input the numerical value of the gloss level of the sheets S in the selected cassette.

As described, the image forming apparatus 100 may be designed so that an operator can use one the various methods to input the information about the gloss level of the sheets S of recording medium which are to be used for printing.

Referring to FIG. 14, it is assumed here, for example, that the "gloss coat paper (product of Company A) which is 157 g/m$^2$ in basis weight", was selected as the recording medium for printing. If the operator wants to input this information about the recording medium selection, the operator can select an icon B305 named "OK" to end the process for inputting the information about the sheets S of recording medium to be used for image formation.

The information inputted by the operator through the above described steps is stored in the RAM 102. Then, this information related to the gloss level of the sheets S, which is in the RAM 102, is obtained by the CPU (gloss level information obtaining means), in Step S201.

On the other hand, if the operator does not want to input the selected recording medium choice on the display 111, the operator can select an icon B306 named "Cancel" in the graphics in FIG. 4. With the selection of the icon B306, the selected recording medium choice is discarded.

As described above, the controlling means of the image forming apparatus 100 may be provided with a means for inputting the information about the type of the recording medium on which an image is formed. If the controlling means is provided with such an information inputting means, multiple selections (threshold values, etc.) which correspond, one for one, to the types of the recording medium on which an image is formed are stored in the storing means of the image forming apparatus 100. Thus, the controlling means determines which of the first and second modes is to be used, based on one of the multiple sections which correspond, one for one, to the types of the recording medium (on which an image is going to be formed), and was inputted by the information inputting means. Further, the controlling means of the image forming apparatus 100 may be provided with an information inputting means for inputting the information related to the gloss level of the recording medium on which an image is formed. If the controlling means is provided with such an information inputting means, multiple selections (for such information as threshold value), which correspond, one for one, to the gloss levels of the recording medium on which an image is formed, are stored in the storage means of the image forming apparatus 100. Thus, the controlling means determines which of the first and second modes is to be used, based on the information which is related to the gloss level of the recording medium (on which an image is to be formed), and was inputted through the information inputting means. In this embodiment, the information inputting means comprises the control panel 112, etc.

3. Control Flow

Next, the flow of the operation carried out by the image forming apparatus 100 when the apparatus 100 is in the transparent image formation mode in this embodiment is described.

Figure 15:
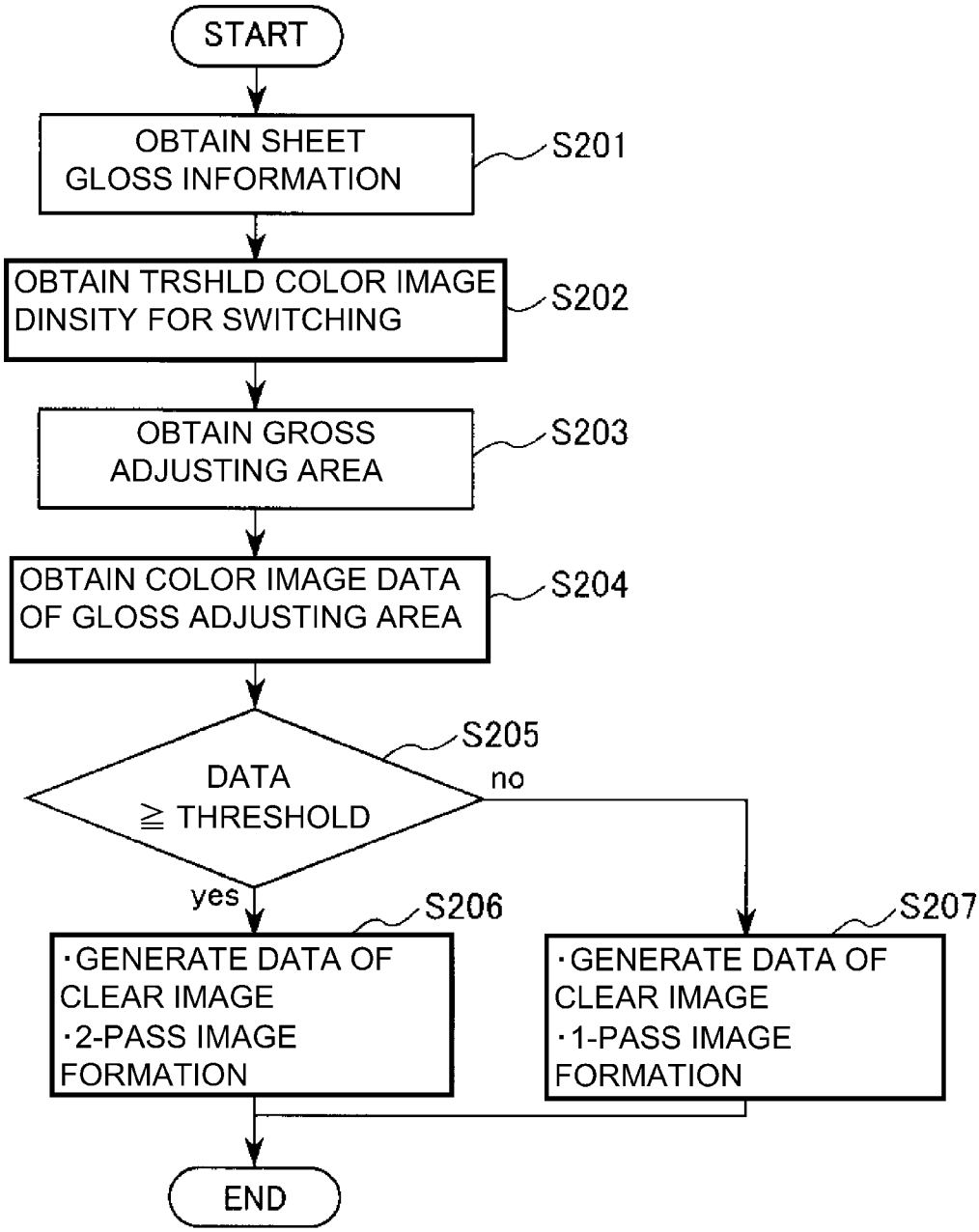
FIG. 15 is a flowchart of the image formation sequence carried out by the image forming apparatus in the first embodiment of the present invention, in the transparent image formation mode.

FIG. 15 is a flowchart which shows the flow of the image forming operation carried out by the image forming apparatus 100 when the apparatus 100 is in the transparent image formation mode in this embodiment. When the image forming apparatus 100 is in the transparent toner image formation mode, the CPU 101 controls the image forming operation of the image forming apparatus 100 following the flowchart shown in FIG. 15.

First, in Step S201, the CPU 101 (functioning as gloss level obtaining means) obtains the information related to the gloss level of the recording medium selected by the operator from the graphics shown in FIG. 14.

Next, in Step S202, the CPU 101 obtains the information about the threshold value and the information about which of the negative and positive versions of the transparent toner image data is to be used. These pieces of information are s organized, based on the relationship between the color toner amount on a give area of a sheet S of recording medium and the level at which the given area will be in gloss level after fixation, so that the image forming apparatus 100 outputs a print, the gloss adjustment area of the image formation area of the sheet S of recording medium of which is significantly different in gloss level from the rest.

The processes carried out in Step S203 and thereafter (S203-S207) are the same as those (S101-S106) in the first embodiment described with reference to FIG. 7, except for the process for generating the transparent toner image data. That is, the negative or positive versions of the transparent toner image data are generated based on the gloss level of the selected sheet S of recording medium, as in the first to third embodiments.

In a case where the relationship between the recording medium types and the information about the relationship between the color toner amount and gloss level has been established, the CPU 101 (functioning as recording medium type obtaining means) obtains the information about the type of the sheet S of recording medium, in a step which corresponds to the aforementioned Step S201. As described above, the information which shows the type of the sheet S of recording medium, information which shows the relationship between the color toner amount and gloss level is such information that is for determining which table (which shows this relationship), threshold value, and/or method for generating transparent toner image data and/or is to be used. In this case, the CPU 101 uses the aforementioned information (stored in relation to recording medium type), to control the image formation operation of the image forming apparatus 100, according to the type of the sheet S of recording medium, in steps which correspond to Steps S203-S207, when the apparatus 100 is in the transparent toner image formation mode.

As described above, according to this embodiment, it is possible to make the image forming apparatus 100 output a print, the area of which selected by an operator is distinctively different in gloss level from the rest, based on the type or gloss level of the sheet S of recording medium to be used for image formation. Further, it is possible to control the image forming apparatus 100 in a wider range in terms of the amount of the gloss level between a given area or given areas of a sheet S of recording medium and the rest when the apparatus 100 is used in the transparent image formation mode, than any image forming apparatus controlling method in accordance with the prior art.

[Miscellanies]

The present invention has been described above, with reference to its preferred embodiments.

However, these embodiments are not intended to limit the present invention in scope.

For example, the means for enabling image forming apparatus 100 to obtain the information about the type and gloss level of the sheet S of recording medium is not limited to the means through which the information is to be directly inputted into the image forming apparatus 100 by an operator. For example, in a case where the image forming apparatus 100 is provided with a means for detecting the type and gloss level of the sheet S of recording medium which is to be used for outputting an image, the image forming apparatus 100 may be designed so that the type and gloss level of the sheet S detected by the detecting means are automatically inputted into the CPU of the image forming apparatus 100. Further, the image forming apparatus 100 may be designed so that it can directly detect the gloss level of the sheet S, or indirectly detect it by detecting the type (ordinary paper, low gloss paper, high gloss paper, etc.), using the thickness an/or surface roughness of the sheet S, as the indexes for determining the type of the sheet S.

Further, the recording mediums usable by the image forming apparatus 100 in accordance with the present invention are not limited to those mentioned above. That is, recording mediums different in type from those mentioned above can be dealt with by obtaining the necessary information, such as the above described threshold value, from the information which shows the relationship between the color toner amount and gloss level, and inputting the necessary information in advance.

Further, in the description of the preceding embodiments, the gloss adjustment area was selected by selecting one the image files stored in advance in the image forming apparatus 100 or network. However, these embodiments are not intended to limit the present invention in scope in terms of the method for selecting a gloss adjustment area. For example, the image forming apparatus 100 may be designed so that when copying an original, a copy, the gloss level adjustment area of which corresponds to that of the image portion of another original, will be outputted. In such a case, first, an original for showing to the image forming apparatus 100 the gloss level adjustment area for a copy (print to be outputted) of the original to be formed is read by the scanner section 116, and its information is stored in the RAM 102 or HDD 104. Then, the original, the copy of which is to be made, is read by the scanner section 116, and its information is stored in the RAM 102 or HDD 104. Then, the CPU 101 obtains the information about the amount by which color toner will be adhered to the gloss level adjustment area of the sheet S of recording medium, based on the data of the original for showing the color toner amount and the data of the original to be copied, in the RAM 102 or HDD 104, and uses the obtained information to determine which of the single-pass image formation method and double-pass image formation method is to be used, and also, to select the method for generating the transparent image data. Thereafter, the CPU 101 controls the image formation operation of the image forming apparatus 100 in the transparent image formation mode, in the same manner as it did in the preceding embodiments.

Also in the preceding embodiments described above, whether the single-pass image formation method or the double-pass image formation method is to be used is determined using the information about the amount by which color toner will be adhered to the gloss level adjustment area of a print to be outputted, as the information about the color toner amount of the color image, for the following reason. That is, in a case where a print, the gloss level adjustment area of which is distinctively different in gloss level from the rest, is made in the transparent image formation mode, the area of the sheet S of recording medium, which is adjacent to the area of the sheet S, which is to be adjusted in gloss level, is frequently roughly the same in the amount of color toner amount as the gloss level of the gloss level adjustment area. That is, ordinarily, it is unthinkable that when producing a color print (color image), the selected area of which is distinctively different in gloss level from the rest, in the transparent image formation mode, the gloss level adjustment area is the only area of the print, which is significantly different in image density from the adjacent area. Therefore, by determining whether the single-pass image formation method or double-pass image formation method is to be used, based on the relationship between the color toner amount and gloss level, such as the one shown in FIGS. 3 and 4, which is obtained in advance, it is possible to produce a print, the gloss level adjustment area of which is distinctively different in gloss level from the adjacent area. However, the preceding embodiments are not intended to limit the present invention in scope in terms of determining whether the single-pass image formation method or double-pass image formation method is to be used. For example, whether the single-pass method or double-pass method is to be used may be determined using the information about the color toner amount (average color toner amount, for example) across the entirety of the image formation area of the sheet S of recording medium, as the information about the information about the color toner amount of the color image.

Further, in the preceding embodiments, the transparent toner amount of the transparent image formed in the transparent image formation mode was 70%. However, these embodiments are not intended to limit the present invention in scope in terms of the amount of the transparent toner of the transparent image formed in the transparent toner image formation mode.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 012319/2011 filed Jan. 24, 2011 which is hereby incorporated by reference.

What is claimed is:

1. An image forming apparatus comprising:

non-transparent image forming means for forming a non-transparent toner image with non-transparent toner on a recording material;

transparent image forming means for forming a transparent toner image with transparent toner on a part of an image forming area on the recording material on which the non-transparent toner image is formed by said non-transparent image forming means;

fixing means for fixing the toner images on the recording material by heating;

control means for selectively executing an operation in a first mode in which the non-transparent toner image is formed, then the transparent toner image is formed on the recording material not yet subjected to the heating, then the recording material is subjected to the heating, and then the recording material is outputted, or an operation in a second mode in which the non-transparent toner image is formed, then the transparent toner image is formed on the recording material subjected to the heating, then the recording material is subjected to the heating, and then the recording material is outputted; and storing means for storing selection information to be compared, by said control means, with information relating to a toner amount of the non-transparent toner image to be formed on the recording material in selection of the first mode or the second mode, wherein the selection information indicates which of the first mode or the second mode provides a larger difference in a glossiness of the image fixed on the recording material by said fixing means between when the transparent toner image of a predetermined amount is overlaid on the non-transparent toner image of a amount to be formed on the recording material and when the transparent toner image is not overlaid.

2. An apparatus according to claim 1, further comprising inputting means for inputting information relating to kinds of the recording material to said control means, wherein said storing means stores a plurality of pieces of information corresponding to the kinds of the recording material, and said control means selects the modes on the basis of the selection information corresponding to the kind of the recording material inputted by said inputting means.

3. An apparatus according to claim 1, further comprising inputting means for inputting information relating to glossinesses of the recording material, wherein said storing means stores a plurality of pieces of the selection information corresponding to the glossiness of the recording material, and said control means selects the modes on the basis of the selection information corresponding to the glossiness of the recording material inputted by said inputting means.

4. An image forming apparatus according to claim 1, wherein said control means compares, with the selection information, the information which is the information relating to the toner amount of the non-transparent image formed on the recording material and which relate to the amount of the non-transparent toner image in an area in which the transparent toner image is formed in the image forming area on the recording material, and selects the first or second mode on the basis of the comparison.

* * * * *